US011257423B2

(12) United States Patent
Liu et al.

(10) Patent No.: US 11,257,423 B2
(45) Date of Patent: Feb. 22, 2022

(54) PIXEL DRIVING CIRCUIT AND DRIVING METHOD THEREOF, AND DISPLAY PANEL

(71) Applicant: BOE TECHNOLOGY GROUP CO., LTD., Beijing (CN)

(72) Inventors: Dongni Liu, Beijing (CN); Minghua Xuan, Beijing (CN); Qi Qi, Beijing (CN); Jing Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/294,556

(22) PCT Filed: Sep. 27, 2020

(86) PCT No.: PCT/CN2020/118056
§ 371 (c)(1),
(2) Date: May 17, 2021

(87) PCT Pub. No.: WO2021/082840
PCT Pub. Date: May 6, 2021

(65) Prior Publication Data

US 2021/0407380 A1 Dec. 30, 2021

(30) Foreign Application Priority Data

Nov. 1, 2019 (CN) ..... 201911062023.4

(51) Int. Cl.
*G09G 3/32* (2016.01)

(52) U.S. Cl.
CPC ..... *G09G 3/32* (2013.01); *G09G 2300/0426* (2013.01); *G09G 2300/0809* (2013.01); *G09G 2310/061* (2013.01); *G09G 2330/021* (2013.01)

(58) Field of Classification Search
CPC ..... G09G 3/32; G09G 2300/0426; G09G 2300/0809; G09G 2310/061; G09G 2330/021
See application file for complete search history.

(56) References Cited

U.S. PATENT DOCUMENTS

2004/0140968 A1 7/2004 Kasai et al.
2005/0156832 A1 7/2005 Ono
(Continued)

FOREIGN PATENT DOCUMENTS

CN 1499463 A 5/2004
CN 1755778 A 4/2006
(Continued)

OTHER PUBLICATIONS

First Office Action dated Oct. 11, 2021 by the China National Intellectual Property Administration for China patent application No. 201911062023.4.

*Primary Examiner* — Andrew Sasinowski
(74) *Attorney, Agent, or Firm* — IP & T Group LLP

(57) ABSTRACT

A pixel driving circuit includes a driving control sub-circuit and a driving duration control sub-circuit. The driving control sub-circuit includes a first driving sub-circuit connected to a first node. The driving control sub-circuit is configured to be connected to an element to be driven. The driving control sub-circuit is configured to output a driving signal to drive the element to be driven to operate. The driving duration control sub-circuit includes a second driving sub-circuit connected to a second node. The driving duration control sub-circuit is configured to write a first voltage signal into the second node, write a third voltage signal into the second node, and transmit a second voltage signal to the first node in response to a voltage variation at the second node to stop the first driving sub-circuit from
(Continued)

outputting the driving signal, so as to control an operating duration of the element to be driven.

19 Claims, 8 Drawing Sheets

(56) References Cited

U.S. PATENT DOCUMENTS

| | | | | |
|---|---|---|---|---|
| 2006/0164359 | A1 | 7/2006 | Kimura | |
| 2006/0208977 | A1 | 9/2006 | Kimura | |
| 2007/0200803 | A1 | 8/2007 | Kimura | |
| 2011/0050761 | A1 | 3/2011 | Yoneyama | |
| 2016/0210906 | A1 | 7/2016 | In et al. | |
| 2017/0061877 | A1 | 3/2017 | Lee | |
| 2017/0123539 | A1* | 5/2017 | Wang | G06F 3/044 |
| 2018/0293929 | A1 | 10/2018 | Shigeta et al. | |
| 2018/0301080 | A1 | 10/2018 | Shigeta et al. | |
| 2019/0130865 | A1* | 5/2019 | Xiong | G05F 1/62 |
| 2019/0189233 | A1* | 6/2019 | Su | G11C 19/28 |
| 2020/0184872 | A1* | 6/2020 | Yuan | G11C 19/287 |
| 2020/0302845 | A1* | 9/2020 | Wang | G11C 19/184 |
| 2021/0027699 | A1 | 1/2021 | Zheng et al. | |
| 2021/0174736 | A1 | 6/2021 | Yang et al. | |
| 2021/0233461 | A1 | 7/2021 | Yue et al. | |

FOREIGN PATENT DOCUMENTS

| | | | |
|---|---|---|---|
| CN | 1822083 | A | 8/2006 |
| CN | 1901008 | A | 1/2007 |
| CN | 1904989 | A | 1/2007 |
| CN | 102005170 | A | 4/2011 |
| CN | 103943062 | A | 7/2014 |
| CN | 108538241 | A | 9/2018 |
| CN | 108694908 | A | 10/2018 |
| CN | 108735143 | A | 11/2018 |
| CN | 109859682 | A | 6/2019 |
| CN | 109920371 | A | 6/2019 |
| CN | 109979378 | A | 7/2019 |
| CN | 110010057 | A | 7/2019 |
| CN | 110021263 | A | 7/2019 |
| CN | 110310594 | A | 10/2019 |
| EP | 3816978 | A1 | 6/2019 |
| WO | 2020007024 | A1 | 1/2020 |

* cited by examiner

PIXEL DRIVING CIRCUIT AND DRIVING METHOD THEREOF, AND DISPLAY PANEL

CROSS-REFERENCE TO RELATED APPLICATIONS

This application is a national phase entry under 35 USC 371 of International Patent Application No. PCT/CN 2020/118056 filed on Sep. 27, 2020, which claims priority to Chinese Patent Application No. 201911062023.4, filed on Nov. 1, 2019, which are incorporated herein by reference in their entirety.

TECHNICAL FIELD

The present disclosure relates to the field of display technologies, and in particular, to a pixel driving circuit and a driving method thereof, and a display panel.

BACKGROUND

Compared to an organic light-emitting diode (OLED) display device, a micro light-emitting diode (Micro LED) display device or a mini light-emitting diode (Mini LED) display device has higher luminous efficiency and reliability, as well as lower power consumption, and may become a mainstream of display products in the future. In the Micro LED display device or in the Mini LED display device, pixel driving circuits are used to drive LEDs to emit light, so as to achieve display. Therefore, a structure of the pixel driving circuit is crucial to ensure the display effects of the Micro LED display device or the Mini LED display device.

SUMMARY

In one aspect, a pixel driving circuit is provided. The pixel driving circuit includes a driving control sub-circuit and a driving duration control sub-circuit. The driving control sub-circuit includes a first driving sub-circuit, and the first driving sub-circuit is connected to a first node. The driving control sub-circuit is connected to a scan signal terminal, a data signal terminal, an enable signal terminal, a first power supply voltage signal terminal, and is configured to be connected to an element to be driven. The driving control sub-circuit is configured to: in response to a scan signal received from the scan signal terminal, write at least a data signal provided from the data signal terminal into the first node; and in response to an enable signal received from the enable signal terminal, enable the first driving sub-circuit to output a driving signal according to the data signal and a first power supply voltage signal provided from the first power supply voltage signal terminal, so as to drive the element to be driven to operate.

The driving duration control sub-circuit includes a second driving sub-circuit, and the second driving sub-circuit is connected to a second node. The driving duration control sub-circuit is connected to a control signal terminal, the enable signal terminal, a second reset signal terminal, a first voltage signal terminal, a second voltage signal terminal, a third voltage signal terminal, and the first node. The driving duration control sub-circuit is configured to: in response to a second reset signal received from the second reset signal terminal, write a first voltage signal provided from the first voltage signal terminal into the second node; in response to the enable signal received from the enable signal terminal and a control signal received from the control signal terminal, write a third voltage signal changing within a set voltage range that is provided from the third voltage signal terminal into the second node; and in response to a voltage variation at the second node, transmit a second voltage signal provided from the second voltage signal terminal to the first node to stop the first driving sub-circuit from outputting the driving signal, so as to control an operating duration of the element to be driven.

In some embodiments, the driving control sub-circuit further includes a first data writing sub-circuit and a first control sub-circuit. The first data writing sub-circuit is at least connected to the scan signal terminal, the data signal terminal, and the first node. The first data writing sub-circuit is configured to write at least the data signal into the first node in response to the received scan signal. The first driving sub-circuit is further connected to the first power supply voltage signal terminal. The first driving sub-circuit includes a driving transistor, and the driving transistor is configured to output the driving signal according to the data signal and the first power supply voltage signal. The first control sub-circuit is connected to the enable signal terminal, a second electrode of the driving transistor, and is configured to be connected to the element to be driven. The first control sub-circuit is configured to, in response to the received enable signal, connect the second electrode of the driving transistor to the element to be driven, so as to transmit the driving signal to the element to be driven.

In some embodiments, the first data writing sub-circuit is further connected to a first electrode and the second electrode of the driving transistor. The first data writing sub-circuit is further configured to, in response to the received scan signal, write a first threshold voltage of the driving transistor into the first node, so as to perform a threshold voltage compensation on the driving transistor. The first control sub-circuit is further connected to the first electrode of the driving transistor and the first power supply voltage signal terminal. The first control sub-circuit is further configured to, in response to the received enable signal, connect the first electrode of the driving transistor to the first power supply voltage signal terminal.

In some embodiments, the first driving sub-circuit further includes a first capacitor. A gate of the driving transistor is connected to the first node, a first electrode of the driving transistor is connected to the first power supply voltage signal terminal. An end of the first capacitor is connected to the first node, and another end of the first capacitor is connected to the first power supply voltage signal terminal.

In some embodiments, the first data writing sub-circuit includes a second transistor. A gate of the second transistor is connected to the scan signal terminal, a first electrode of the second transistor is connected to the data signal terminal, and a second electrode of the second transistor is connected to the first node.

In some embodiments, the first control sub-circuit includes a third transistor. A gate of the third transistor is connected to the enable signal terminal, a first electrode of the third transistor is connected to the second electrode of the driving transistor, and a second electrode of the third transistor is configured to be connected to the element to be driven.

In some embodiments, the first driving sub-circuit further includes a first capacitor. A gate of the driving transistor is connected to the first node. An end of the first capacitor is connected to the first node, and another end of the first capacitor is connected to the first power supply voltage signal terminal.

In some embodiments, the first data writing sub-circuit includes a fourth transistor and a fifth transistor. A gate of the fourth transistor is connected to the scan signal terminal, a first electrode of the fourth transistor is connected to the data signal terminal, and a second electrode of the fourth transistor is connected to the first electrode of the driving transistor. A gate of the fifth transistor is connected to the scan signal terminal, a first electrode of the fifth transistor is connected to the second electrode of the driving transistor, and a second electrode of the fifth transistor is connected to the first node.

In some embodiments, the first control sub-circuit includes a sixth transistor and a seventh transistor. A gate of the sixth transistor is connected to the enable signal terminal, a first electrode of the sixth transistor is connected to the first power supply voltage signal terminal, and a second electrode of the sixth transistor is connected to the first electrode of the driving transistor. A gate of the seventh transistor is connected to the enable signal terminal, a first electrode of the seventh transistor is connected to the second electrode of the driving transistor, and a second electrode of the seventh transistor is configured to be connected to the element to be driven.

In some embodiments, the driving control sub-circuit further includes a reset sub-circuit. The reset sub-circuit is connected to a first reset signal terminal, an initial signal terminal, the first node, and is configured to be connected to the element to be driven. The reset sub-circuit is configured to, in response to a first reset signal received from the first reset signal terminal, transmit an initial voltage signal provided from the initial signal terminal to the first node and the element to be driven.

In some embodiments, the reset sub-circuit includes an eighth transistor and a ninth transistor. A gate of the eighth transistor is connected to the first reset signal terminal, a first electrode of the eighth transistor is connected to the initial signal terminal, and a second electrode of the eighth transistor is connected to the first node. A gate of the ninth transistor is connected to the first reset signal terminal, a first electrode of the ninth transistor is connected to the initial signal terminal, and a second electrode of the ninth transistor is configured to be connected to the element to be driven.

In some embodiments, the driving duration control sub-circuit further includes a second data writing sub-circuit, a second control sub-circuit, and a third control sub-circuit. The second driving sub-circuit includes a tenth transistor and a second capacitor. An end of the second capacitor is connected to the second node, another end of the second capacitor is connected to a third node. A gate of the tenth transistor is connected to the third node. The second data writing sub-circuit is connected to the second reset signal terminal, the first voltage signal terminal, and the second node. The second data writing sub-circuit is configured to, in response to the received second reset signal, write the first voltage signal into the second node. The second control sub-circuit is connected to the enable signal terminal, the second voltage signal terminal, the third voltage signal terminal, the second node, and the tenth transistor. The second control sub-circuit is configured to, in response to the received enable signal, write the third voltage signal into the second node, and connect the tenth transistor to the second voltage signal terminal. The third control sub-circuit is connected to the control signal terminal, the tenth transistor, and the first node. The third control sub-circuit is configured to, in response to the received control signal, connect the tenth transistor to the first node. The tenth transistor is configured to, in response to a voltage variation between the third voltage signal and the first voltage signal at the second node, transmit the second voltage signal to the first node.

In some embodiments, the second data writing sub-circuit is further connected to a reference voltage signal terminal and the tenth transistor. The second data writing sub-circuit is further configured to, in response to the received second reset signal, write a reference voltage signal provided from the reference voltage signal terminal into the third node.

In some embodiments, the second control sub-circuit includes an eleventh transistor and a twelfth transistor. A gate of the eleventh transistor is connected to the enable signal terminal, a first electrode of the eleventh transistor is connected to the third voltage signal terminal, and a second electrode of the eleventh transistor is connected to the second node. A gate of the twelfth transistor is connected to the enable signal terminal, a first electrode of the twelfth transistor is connected to the second voltage signal terminal, and a second electrode of the twelfth transistor is connected to a first electrode of the tenth transistor.

In some embodiments, the third control sub-circuit includes a thirteenth transistor. A gate of the thirteenth transistor is connected to the control signal terminal, a first electrode of the thirteenth transistor is connected to a second electrode of the tenth transistor, and a second electrode of the thirteenth transistor is connected to the first node.

In some embodiments, the second data writing sub-circuit includes a fourteenth transistor. A gate of the fourteenth transistor is connected to the second reset signal terminal, a first electrode of the fourteenth transistor is connected to the first voltage signal terminal, and a second electrode of the fourteenth transistor is connected to the second node.

In some embodiments, the second data writing sub-circuit includes a fourteenth transistor, a fifteenth transistor, and a sixteenth transistor. A gate of the fourteenth transistor is connected to the second reset signal terminal, a first electrode of the fourteenth transistor is connected to the first voltage signal terminal, and a second electrode of the fourteenth transistor is connected to the second node. A gate of the fifteenth transistor is connected to the second reset signal terminal, a first electrode of the fifteenth transistor is connected to the reference voltage signal terminal, and a second electrode of the fifteenth transistor is connected to a first electrode of the tenth transistor. A gate of the sixteenth transistor is connected to the second reset signal terminal, a first electrode of the sixteenth transistor is connected to a second electrode of the tenth transistor, and a second electrode of the sixteenth transistor is connected to the third node.

In another aspect, a display panel is provided. The display panel includes a plurality of pixel driving circuits and a plurality of elements to be driven as described above. Each element to be driven is connected to a corresponding pixel driving circuit.

In some embodiments, the display panel has a plurality of sub-pixel regions, and each pixel driving circuit is disposed in one sub-pixel region. The display panel further includes a plurality of scan signal lines, a plurality of data signal lines, a plurality of enable signal lines, and a plurality of third voltage signal lines. Scan signal terminals connected to pixel driving circuits located in a same row of sub-pixel regions are connected to a corresponding scan signal line. Data signal terminals connected to pixel driving circuits located in a same column of sub-pixel regions are connected to a corresponding data signal line. Enable signal terminals connected to pixel driving circuits located in a same row of sub-pixel regions are connected to a corresponding enable signal line. Third voltage signal terminals connected to pixel driving circuits located in a same column of sub-pixel regions are connected to a corresponding third voltage signal line.

In yet another aspect, a driving method of the pixel driving circuit as described above is provided. A frame period includes a scanning phase and an operating phase, and the scanning phase includes a plurality of row scanning phases. The driving method includes following processes. In each of the plurality of row scanning phases, the driving control sub-circuit writes at least the data signal from the data signal terminal into the first node in response to the scan signal received from the scan signal terminal, and the driving duration control sub-circuit writes the first voltage signal from the first voltage signal terminal into the second node in response to the second reset signal received from the second reset signal terminal. In the operating phase, in response to the enable signal received from the enable signal terminal, the driving control sub-circuit enables the first driving sub-circuit to output the driving signal according to the data signal and the first power supply voltage signal provided from the first power supply voltage signal terminal, so as to drive the element to be driven to operate; in response to the enable signal received from the enable signal terminal and the control signal received from the control signal terminal, the driving duration control sub-circuit writes the third voltage signal changing within the set voltage range from the third voltage signal terminal into the second node; and in response to the voltage variation between the third voltage signal and the first voltage signal, the driving duration control sub-circuit transmits the second voltage signal provided from the second voltage signal terminal to the first node to stop the first driving sub-circuit from outputting the driving signal, so as to control the operating to duration of the element to be driven.

In some embodiments, the driving control sub-circuit further includes a first data writing sub-circuit and a first control sub-circuit. The first data writing sub-circuit is at least connected to the scan signal terminal, the data signal terminal, and the first node. The first driving sub-circuit includes a driving transistor. The first driving sub-circuit is connected to the first node and the first power supply voltage signal terminal. The first control sub-circuit is connected to the enable signal terminal, a second electrode of the driving transistor, and the element to be driven.

In each of the plurality of row scanning phases, the driving control sub-circuit writing at least the data signal into the first node in response to the received scan signal, and in the operating phase, in response to the received enable signal, the driving control sub-circuit enabling the first driving sub-circuit to output the driving signal according to the data signal and the first power supply voltage signal, so as to drive the element to be driven to operate, includes: in each of the plurality of row scanning phases, the first data writing sub-circuit writing the data signal into the first node in response to the received scan signal; and in the operating phase, the driving transistor outputting the driving signal according to the data signal and the first power supply voltage signal; and the first control sub-circuit connecting the second electrode of the driving transistor to the element to be driven in response to the received enable signal, so as to transmit the driving signal to the element to be driven to drive the element to be driven to operate.

In some embodiments, the first data writing sub-circuit is further connected to a first electrode and the second electrode of the driving transistor. The first control sub-circuit is further connected to the first electrode of the driving transistor and the first power supply voltage signal terminal. The driving method further includes: in each of the plurality of row scanning phases, the first data writing sub-circuit writing a first threshold voltage of the driving transistor into the first node in response to the received scan signal, so as to perform a threshold voltage compensation on the driving transistor; and in the operating phase, the first control sub-circuit connecting the first electrode of the driving transistor to the first power supply voltage signal terminal in response to the received enable signal, so that the first power supply voltage signal is transmitted to the driving transistor.

In some embodiments, the driving duration control sub-circuit further includes a second data writing sub-circuit, a second control sub-circuit, and a third control sub-circuit. The second driving sub-circuit includes a tenth transistor and a second capacitor. An end of the second capacitor is connected to the second node, and another end of the second capacitor is connected to a third node. A gate of the tenth transistor is connected to the third node. The second data writing sub-circuit is connected to the second reset signal terminal, the first voltage signal terminal, and the second node. The second control sub-circuit is connected to the enable signal terminal, the second voltage signal terminal, the third voltage signal terminal, the second node, and the tenth transistor. The third control sub-circuit is connected to the control signal terminal, the tenth transistor, and the first node.

In each of the plurality of row scanning phases, the driving duration control sub-circuit writing the first voltage signal into the second node in response to the received second reset signal, and in the operating phase, the driving duration control sub-circuit writing the third voltage signal into the second node in response to the received enable signal and the control signal, and transmitting the second voltage signal to the first node in response to the voltage variation between the third voltage signal and the first voltage signal, includes: in each of the plurality of row scanning phases, the second data writing sub-circuit writing the first voltage signal into the second node in response to the received second reset signal; and in the operating phase, the second control sub-circuit writing the third voltage signal into the second node, and connecting the tenth transistor to the second voltage signal terminal in response to the received enable signal, the third control sub-circuit connecting the tenth transistor to the first node in response to the received control signal, and the tenth transistor transmitting the second voltage signal to the first node in response to the voltage variation between the third voltage signal and the first voltage signal.

In some embodiments, the second data writing sub-circuit is further connected to a reference voltage signal terminal and the tenth transistor. The driving method further includes: in each of the plurality of row scanning phases, the second data writing sub-circuit writing a reference voltage data provided from the reference voltage signal terminal into the third node in response to the received second reset signal.

BRIEF DESCRIPTION OF THE DRAWINGS

In order to describe technical solutions of the present disclosure or the prior art more clearly, accompanying drawings to be used in some embodiments of the present disclosure or the prior art will be introduced below briefly. Obviously, the accompanying drawings to be described below are merely accompanying drawings of some embodiments of the present disclosure, and a person of ordinary skill in the art can obtain other drawings according to those drawings. In addition, accompanying drawings in the following description may be regarded as schematic diagrams, and are not limitations on an actual size of a product, and an actual timing of a signal involved in the embodiments of the present disclosure.

DETAILED DESCRIPTION

Figure 1:
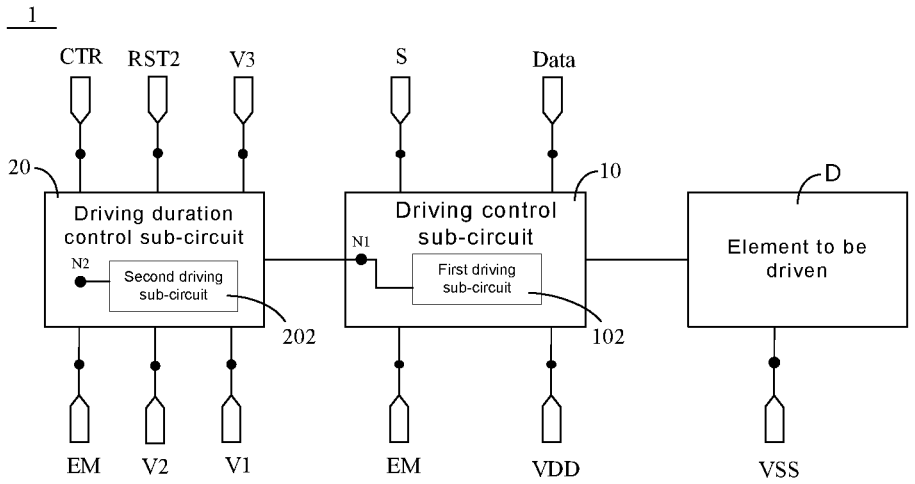
FIG. 1 is a structural block diagram of a pixel driving circuit, in accordance with some embodiments of the present disclosure.

Technical solutions in some embodiments of the present disclosure will be described clearly and completely with reference to the accompanying drawings below. Obviously, the described embodiments are merely some but not all embodiments of the present disclosure. All other embodiments obtained by a person of ordinary skill in the art based on the embodiments of the present disclosure shall be included in the protection scope of the present disclosure.

Unless the context requires otherwise, throughout the description and the claims, the term "comprise" and other forms thereof such as the third-person singular form "comprises" and the present participle form "comprising" are construed as an open and inclusive meaning, i.e., "including, but not limited to". In the description of the specification, the terms such as "one embodiment", "some embodiments", "exemplary embodiments", "an example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics may be included in any one or more embodiments or examples in any suitable manner.

Hereinafter, the terms "first" and "second" are only used for descriptive purposes, and are not to be construed as indicating or implying the relative importance or implicitly indicating the number of indicated technical features. Thus, a feature defined by "first" or "second" may explicitly or implicitly include one or more of the features. In the description of the embodiments of the present disclosure, "a/the plurality of" means two or more unless otherwise specified.

In the description of some embodiments, the term "connected" and derivatives thereof may be used. For example, the term "connected" may be used in the description of some embodiments to indicate that two or more components are in direct physical or electric contact with each other. The embodiments disclosed herein are not necessarily limited to the contents herein.

In the circuits provided from the embodiments of the present disclosure, first, second, and third nodes do not represent actual components, but represent junctions of related electrical connections in circuit diagrams. That is, these nodes are points that are equivalent to the junctions of the related electrical connections in the circuit diagrams.

The phrase "A and/or B" includes the following three combinations: only A, only B, and a combination of A and B.

The use of "configured to" herein is meant as open and inclusive expression, which does not exclude devices applicable to or configured to perform additional tasks or steps.

Additionally, the use of "based on" is meant to be open and inclusive, in that a process, step, calculation, or other actions "based on" one or more stated conditions may, in practice, be based on additional conditions.

In the field of display technologies, light-emitting diode display devices have the advantages of high brightness and wide color gamut, and thus will be more and more widely used in the display field in the future.

The display device includes a display panel, and the display panel has a plurality of sub-pixel regions. Each sub-pixel region is provided with a pixel driving circuit and an element to be driven connected to the pixel driving circuit. The element to be driven is a current-driven light-emitting device. In some examples, the element to be driven is a current light-emitting diode, such as a micro light-emitting diode (Micro LED), a mini light-emitting diode (Mini LED), or an organic electroluminescent diode (i.e., organic light-emitting diode (OLED)).

In a case where the element to be driven is the current-driven light-emitting device, when a driving current of the element to be driven is large, the element to be driven is at a high current density, which results in a high luminous efficiency, a stable brightness, and a low energy consumption of the element to be driven. However, when the driving current of the element to be driven is small, the element to be driven is at a low current density, which results in a low luminous efficiency, a shifted principal peak, an unstable brightness, and a high energy consumption of the element to be driven. The unstable brightness of the element to be driven causes an actual brightness during display to be lower than a set value, which affects the display effects.

The luminous efficiency of the element to be driven is high at a high current density, and the luminous efficiency is low and the principal peak is shifted at a low current density, which are expressed as: when the driving current input to the element to be driven reaches a certain value, the luminous efficiency of the element to be driven is the highest, that is, the principal peak is reached; and when the driving current of the element to be driven does not reach the certain value, the luminous efficiency of the element to be driven is always in a rising stage, and in this case, the luminous efficiency of the element to be driven does not reach the principal peak. That is, as the driving current increases, the brightness of the element to be driven gradually increases, and the luminous efficiency gradually increases at the same time.

In the related art, the brightness of the element to be driven is mainly controlled by controlling the magnitude of the driving current input to the element to be driven, and a luminous duration of the element to be driven is a constant value. In this way, for the elements to be driven located in the sub-pixel regions, display of different gray scales is realized at a same luminous duration and different driving currents. That is, when display of low gray scales is realized, it is required to provide a small driving current to lower the brightness of the element to be driven. When display of high gray scales is realized, it is required to provide a large driving current to increase the brightness of the element to be driven.

In summary, in the related art, the brightness of the element to be driven is controlled by adjusting the magnitude of the driving current. When the display of low gray scales is realized, the driving current input to the element to be driven is small, and the element to be driven is at a low current density, which leads to problems of low brightness, low luminous efficiency, and high energy consumption of the element to be driven.

Based on this, some embodiments of the present disclosure provide a pixel driving circuit. As shown in FIG. 1, the pixel driving circuit includes a driving control sub-circuit 10 and a driving duration control sub-circuit 20.

The driving control sub-circuit 10 includes a first driving sub-circuit 102, and the first driving sub-circuit 102 is connected to a first node N1.

The driving control sub-circuit 10 is connected to a scan signal terminal S, a data signal terminal Data, an enable signal terminal EM, a first power supply voltage signal terminal VDD, and an element to be driven D. The scan signal terminal S is configured to receive a scan signal, and to input the scan signal to the driving control sub-circuit 10. The data signal terminal Data is configured to receive a data signal, and to input the data signal to the driving control sub-circuit 10. The enable signal terminal EM is configured to receive an enable signal, and to input the enable signal to the driving control sub-circuit 10. The first power supply voltage signal terminal VDD is configured to receive a first power supply voltage signal, and to input the first power supply voltage signal to the driving control sub-circuit 10.

The driving control sub-circuit 10 is configured to: in response to the scan signal received from the scan signal terminal S, write at least the data signal provided from the data signal terminal Data into the first node N1; and in response to the enable signal received from the enable signal terminal EM, enable the first driving sub-circuit 102 to output a driving signal according to the data signal provided from the data signal terminal Data and the first power supply voltage signal provided from the first power supply voltage signal terminal VDD, so as to drive the element to be driven D to operate.

In some embodiments, the driving control sub-circuit 10 is connected to a first electrode of the element to be driven D, and a second electrode of the element to be driven D is connected to a second power supply voltage signal terminal VSS.

In some examples, the first electrode and the second electrode of the element to be driven D are an anode and a cathode, respectively.

The driving duration control sub-circuit 20 includes a second driving sub-circuit 202, and the second driving sub-circuit 202 is connected to a second node N2.

The driving duration control sub-circuit 20 is connected to a control signal terminal CTR, the enable signal terminal EM, a second reset signal terminal RST2, a first voltage signal terminal V1, a second voltage signal terminal V2, a third voltage signal terminal V3, and the first node N1. The control signal terminal CTR is configured to receive a control signal, and to input the control signal to the driving duration control sub-circuit 20. The enable signal terminal EM is configured to receive the enable signal, and to input the enable signal to the driving duration control sub-circuit 20. The second reset signal terminal RST2 is configured to receive a second reset signal, and to input the second reset signal to the driving duration control sub-circuit 20. The first voltage signal terminal V1 is configured to receive a first voltage signal, and to input the first voltage signal to the driving duration control sub-circuit 20. The second voltage signal terminal V2 is configured to receive a second voltage signal, and to input the second voltage signal to the driving duration control sub-circuit 20. The third voltage signal terminal V3 is configured to receive a third voltage signal, and to input the third voltage signal to the driving duration control sub-circuit 20.

The driving duration control sub-circuit 20 is configured to: in response to the second reset signal received from the second reset signal terminal RST2, write the first voltage signal provided from the first voltage signal terminal V1 into the second node N2; in response to the enable signal received from the enable signal terminal EM and the control signal received from the control signal terminal CTR, write the third voltage signal changing within a set voltage range that is provided from the third voltage signal terminal V3 into the second node N2; and in response to a voltage variation at the second node N2, transmit the second voltage signal provided from the second voltage signal terminal V2 to the first node N1 to stop the first driving sub-circuit 102 from outputting the driving signal, so as to control an operating duration of the element to be driven D.

In some embodiments of the present disclosure, the element to be driven D operating may be understood as a current-driven light-emitting device emitting light. The driving control sub-circuit 10 outputs the driving signal to drive the element to be driven D to operate, which may be understood as the driving control sub-circuit 10 outputting a driving current to the current-driven light-emitting device to drive the current-driven light-emitting device to emit light. The operating duration of the element to be driven D may be understood as a luminous duration of the current-driven light-emitting device.

On this basis, variation in a brightness of the element to be driven D may be realized by controlling the magnitude of the driving current (the driving signal) transmitted to the current-driven light-emitting device through the driving control sub-circuit 10, and by controlling the luminous duration of the current-driven light-emitting device through the driving duration control sub-circuit 20, thereby realizing display of corresponding gray scales.

For the pixel driving circuit 1 provided by some embodiments of the present disclosure, the pixel driving circuit 1 includes the driving control sub-circuit 10 and the driving duration control sub-circuit 20. The driving control sub-circuit 10 is configured to provide the driving signal to the element to be driven D. The magnitude of the driving signal (for example, the driving current) is determined by the data signal provided from the data signal terminal Data and the first power supply voltage signal provided from the first power supply voltage signal terminal VDD. The driving duration control sub-circuit 20 is configured to control the operating duration of the element to be driven D. In this way, when display of high gray scales is realized, the brightness of the element to be driven D may be increased by increasing the driving current input to the element to be driven D. When display of low gray scales is realized, the magnitude of the driving current of the element to be driven D may not be lowered (that is, the driving current of the element to be driven D is still maintained at a current during the display of high gray scales), and the brightness of the element to be driven D is lowered by shortening the operating duration of the element to be driven D. Therefore, no matter when the display of high gray scales or the display of low gray scales is realized, the driving current transmitted to the element to be driven D is always large, so that the element to be driven D is always at a high current density, which results in a high luminous efficiency, a stable brightness, a low power consumption, and good display effects of the element to be driven D.

Figure 2:
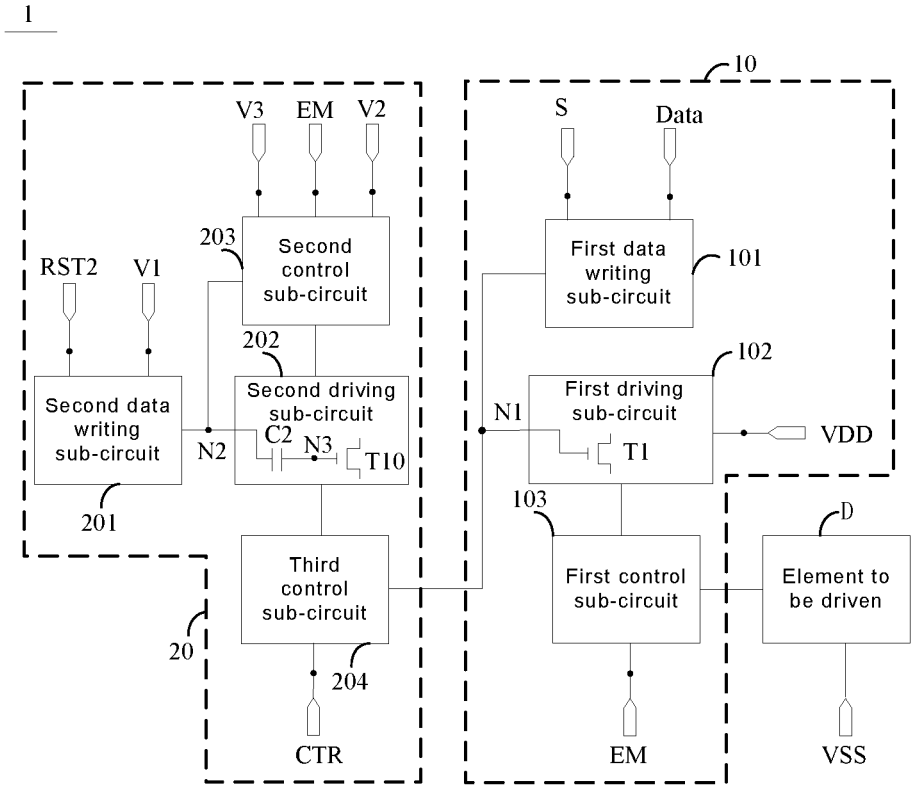
FIG. 2 is a structural block diagram of another pixel driving circuit, in accordance with some embodiments of the present disclosure.

In some embodiments, as shown in FIG. 2, the driving control sub-circuit 10 includes a first data writing sub-circuit 101, the first driving sub-circuit 102, and a first control sub-circuit 103.

The first data writing sub-circuit 101 is connected to the scan signal terminal S, the data signal terminal Data, and the first node N1. The first data writing sub-circuit 101 is configured to write the data signal provided from the data signal terminal Data into the first node N1 in response to the scan signal received from the scan signal terminal S.

The first driving sub-circuit 102 is connected to the first node N1 and the first power supply voltage signal terminal VDD. The first driving sub-circuit 102 includes a driving transistor T1, and the driving transistor T1 is configured to output the driving signal according to the data signal provided from the data signal terminal Data and the first power supply voltage signal provided from the first power supply voltage signal terminal VDD.

The first control sub-circuit 103 is connected to the enable signal terminal EM, a second electrode of the driving transistor T1, and the element to be driven D. The first control sub-circuit 103 is configured to, in response to the enable signal received from the enable signal terminal EM, connect the second electrode of the driving transistor T1 to the element to be driven D, so as to transmit the driving signal to the element to be driven D.

Figure 4:
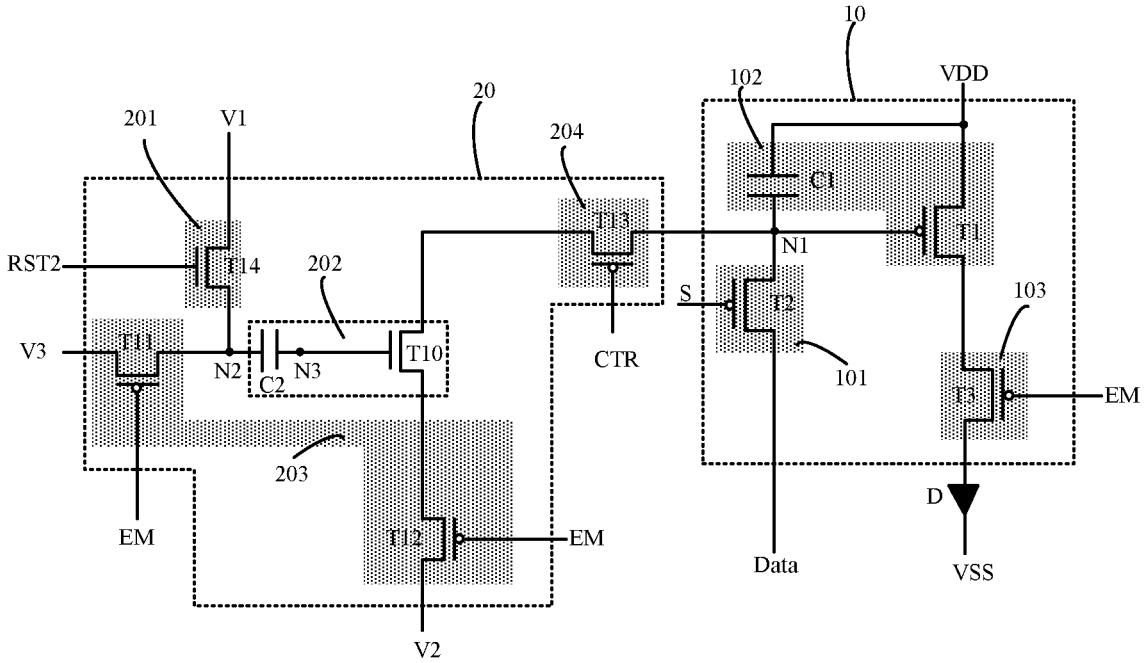
FIG. 4 is a schematic diagram showing a circuit configuration of a pixel driving circuit, in accordance with some embodiments of the present disclosure.

In some examples, as shown in FIG. 4, the first driving sub-circuit 102 includes the driving transistor T1 and a first capacitor C1.

A gate of the driving transistor T1 is connected to the first node N1, a first electrode of the driving transistor T1 is connected to the first power supply voltage signal terminal VDD, and the second electrode of the driving transistor T1 is connected to the first control sub-circuit 103.

An end of the first capacitor C1 is connected to the first node N1, and another end of the first capacitor C1 is connected to the first power supply voltage signal terminal VDD.

The first capacitor C1 is configured to receive the data signal from the data signal terminal Data input by the first data writing sub-circuit 101, and to store the data signal. The driving transistor T1 is configured to output the driving signal according to the data signal stored in the first capacitor C1 and the first power supply voltage signal provided from the first power supply voltage signal terminal VDD, and to transmit the driving signal to the first control sub-circuit 103.

In some examples, as shown in FIG. 4, the first data writing sub-circuit 101 includes a second transistor T2. A gate of the second transistor T2 is connected to the scan signal terminal S, a first electrode of the second transistor T2 is connected to the data signal terminal Data, and a second electrode of the second transistor T2 is connected to the first node N1.

The second transistor T2 is configured to be turned on in response to the scan signal received from the scan signal terminal S, so that the data signal provided from the data signal terminal Data is transmitted to the first node N1.

In some examples, as shown in FIG. 4, the first control sub-circuit 103 includes a third transistor T3. A gate of the third transistor T3 is connected to the enable signal terminal EM, a first electrode of the third transistor T3 is connected to the second electrode of the driving transistor T1, and a second electrode of the third transistor T3 is to connected to the first electrode of the element to be driven D.

The third transistor T3 is configured to be turned on in response to the enable signal received from the enable signal terminal EM, so that the second electrode of the driving transistor T1 is connected to the element to be driven D, so as to transmit the driving signal to the element to be driven D, and to make the element to be driven D emit light.

The embodiments of the present disclosure do not limit the types of the driving transistor T1, the second transistor T2, and the third transistor T3. For example, as shown in FIG. 4, the driving transistor T1, the second transistor T2, and the third transistor T3 are all P-type transistors. For another example, the driving transistor T1, the second transistor T2, and the third transistor T3 are all N-type transistors.

In the driving control sub-circuit 10, the data signal provided from the data signal terminal Data is written into the first node N1 through the first data writing sub-circuit 101, so that a voltage of the first node N1 is a voltage $V_{data}$ of the data signal. Since the gate of the driving transistor T1 is connected to the first node N1, a gate voltage of the driving transistor T1 is equal to the voltage of the first node N1, that is, the gate voltage of the driving transistor T1 is equal to $V_{data}$. In addition, the first electrode of the driving transistor T1 is connected to the first power supply voltage signal terminal VDD, and thus, a voltage of the first electrode of the driving transistor T1 is a voltage $V_{dd}$ of the first power supply voltage signal. In this way, in an example where the driving transistor T1 is a P-type transistor, the driving transistor T1 is turned on when a difference between the gate voltage $V_{data}$ thereof and the voltage $V_{dd}$ of the first electrode thereof is less than a first threshold voltage $V_{th1}$ of the driving transistor T1. That is, when $V_{data}-V_{dd}<V_{th1}$, the driving transistor T1 is turned on, and outputs the driving signal. In response to the enable signal received from the enable signal terminal EM, the first control sub-circuit 103 connects the second electrode of the driving transistor T1 to the element to be driven D, thereby transmitting the driving signal to the element to be driven D, so as to drive the element to be driven D to emit light.

The first driving sub-circuit 102, the first data writing sub-circuit 101, and the first control sub-circuit 103 are in simple connections, so that a structure of the entire driving control sub-circuit 10 is simple, which facilitates manufacturing of the driving control sub-circuit 10, and is beneficial to reduce manufacturing costs.

For example, referring to FIG. 4, the driving control sub-circuit 10 includes the driving transistor T1, the first capacitor C1, the second transistor T2, and the third transistor T3.

The gate of the driving transistor T1 is connected to the first node N1, the first electrode of the driving transistor T1 is connected to the first power supply voltage signal terminal VDD, and the second electrode of the driving transistor T1 is connected to the first electrode of the third transistor T3.

The end of the first capacitor C1 is connected to the first node N1, and the another end of the first capacitor C1 is connected to the first power supply voltage signal terminal VDD and the first electrode of the driving transistor T1.

The gate of the second transistor T2 is connected to the scan signal terminal S, the first electrode of the second transistor T2 is connected to the data signal terminal Data, and the second electrode of the second transistor T2 is connected to the first node N1.

The gate of the third transistor T3 is connected to the enable signal terminal EM, and the second electrode of the third transistor T3 is connected to the first electrode of the element to be driven D.

Figure 3:
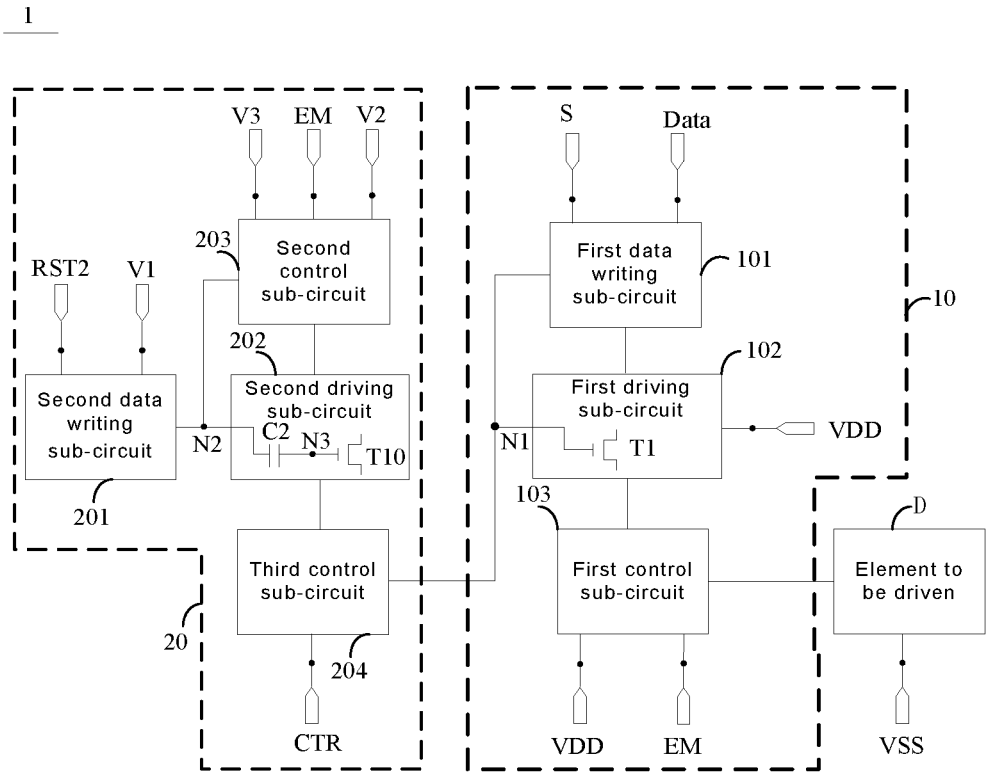
FIG. 3 is a structural block diagram of yet another pixel driving circuit, in accordance with some embodiments of the present disclosure.

In some other embodiments, as shown in FIG. 3, the driving control sub-circuit 10 includes a first data writing sub-circuit 101, the first driving sub-circuit 102, and a first control sub-circuit 103. The first driving sub-circuit 102 includes a driving transistor T1.

The first data writing sub-circuit 101 is connected to the scan signal terminal S, the data signal terminal Data, the first node N1, and a first electrode and a second electrode of the driving transistor T1. The first data writing sub-circuit 101 is configured to write the data signal provided from the data signal terminal Data and a first threshold voltage of the driving transistor T1 into the first node N1 in response to the scan signal received from the scan signal terminal S. Writing the first threshold voltage into the first node N1 may perform a threshold voltage compensation on the driving transistor T1.

The first driving sub-circuit 102 is connected to the first node N1 and the first power supply voltage signal terminal VDD. The driving transistor T1 is configured to output the driving signal according to the data signal provided from the data signal terminal Data and the first power supply voltage signal provided from the first power supply voltage signal terminal VDD.

The first control sub-circuit 103 is connected to the enable signal terminal EM, the first power supply voltage signal terminal VDD, the first electrode and the second electrode of the driving transistor T1, and the element to be driven D. The first control sub-circuit 103 is configured to, in response to the enable signal received from the enable signal terminal EM, connect the first electrode of the driving transistor T1 to the first power supply voltage signal terminal VDD, and connect the second electrode of the driving transistor T1 to the element to be driven D.

Figure 5:
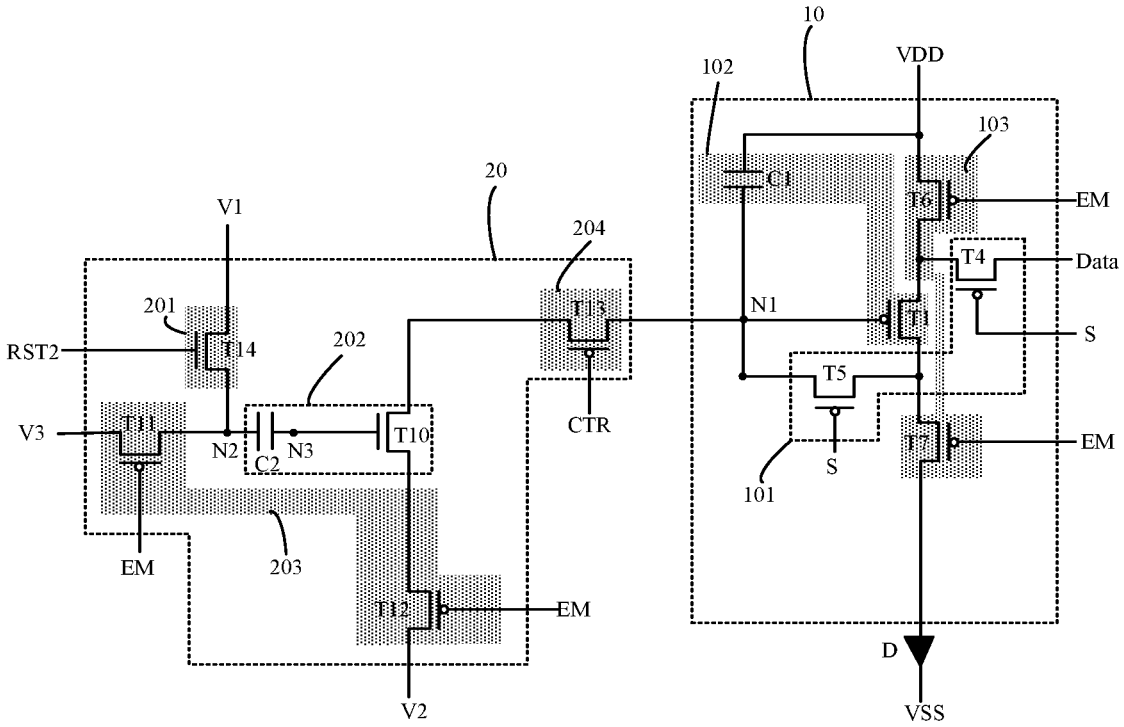
FIG. 5 is a schematic diagram showing a circuit configuration of another pixel driving circuit, in accordance with some embodiments of the present disclosure.

In some examples, as shown in FIG. 5, the first driving sub-circuit 102 includes the driving transistor T1 and a first capacitor C1.

A gate of the driving transistor T1 is connected to the first node N1, the first electrode and the second electrode of the driving transistor T1 are connected to the first control sub-circuit 103, and the first electrode and the second electrode of the driving transistor T1 are connected to the first data writing sub-circuit 101.

An end of the first capacitor C1 is connected to the first node N1, and another end of the first capacitor C1 is connected to the first power supply voltage signal terminal VDD.

The first capacitor C1 is configured to receive and store the data signal written by the first data writing sub-circuit 101 and the first threshold voltage of the driving transistor T1, and to transmit the data signal and the first threshold voltage to the gate of the driving transistor T1. The driving transistor T1 is configured to output the driving signal according to a voltage of the data signal stored in the first capacitor C1, the first threshold voltage of the driving transistor T1, and the first power supply voltage signal provided from the first power supply voltage signal terminal VDD.

In some examples, as shown in FIG. 5, the first data writing sub-circuit 101 includes a fourth transistor T4 and a fifth transistor T5.

A gate of the fourth transistor T4 is connected to the scan signal terminal S, a first electrode of the fourth transistor T4 is connected to the data signal terminal Data, and a second electrode of the fourth transistor T4 is connected to the first electrode of the driving transistor T1.

A gate of the fifth transistor T5 is connected to the scan signal terminal S, a first electrode of the fifth transistor T5 is connected to the second electrode of the driving transistor T1, and a second electrode of the fifth transistor T5 is connected to the first node N1.

The fourth transistor T4 is configured to be turned on in response to the scan signal received from the scan signal terminal S, so that the data signal provided from the data signal terminal Data is transmitted to the first electrode of the driving transistor T1. The fifth transistor T5 is configured to be turned on in response to the scan signal received from the scan signal terminal S, so as to short-circuit the gate of the driving transistor T1 to the second electrode thereof, and to make the driving transistor T1 be in a saturation state, thereby transmitting the data signal and the first threshold voltage to the first node N1.

In some examples, as shown in FIG. 5, the first control sub-circuit 103 includes a sixth transistor T6 and a seventh transistor T7.

A gate of the sixth transistor T6 is connected to the enable signal terminal EM, a first electrode of the sixth transistor T6 is connected to the first power supply voltage signal terminal VDD, and a second electrode of the sixth transistor T6 is connected to the first electrode of the driving transistor T1.

A gate of the seventh transistor T7 is connected to the enable signal terminal EM, a first electrode of the seventh transistor T7 is connected to the second electrode of the driving transistor T1, and a second electrode of the seventh transistor T7 is connected to the first electrode of the element to be driven D.

The sixth transistor T6 is configured to be turned on in response to the enable signal received from the enable signal terminal EM, so that the first electrode of the driving transistor T1 is connected to the first power supply voltage signal terminal VDD, so as to transmit the first power supply voltage signal provided from the first power supply voltage signal terminal VDD to the first electrode of the driving transistor T1. The seventh transistor T7 is configured to be turned on in response to the enable signal received from the enable signal terminal EM, so that the second electrode of the driving transistor T1 is connected to the element to be driven D, so as to transmit the driving signal to the element to be driven D to make the element to be driven D operate.

The embodiments of the present disclosure do not limit the types of the driving transistor T1, the fourth transistor T4, the fifth transistor T5, the sixth transistor T6, and the seventh transistor T7. For example, as shown in FIG. 5, the driving transistor T1, the fourth transistor T4, the fifth transistor T5, the sixth transistor T6, and the seventh transistor T7 are all P-type transistors. For another example, the driving transistor T1, the fourth transistor T4, the fifth transistor T5, the sixth transistor T6, and the seventh transistor T7 are all N-type transistors.

In the driving control sub-circuit 10, the data signal provided from the data signal terminal Data and the first threshold voltage of the driving transistor T1 are written into the first node N1 through the first data writing sub-circuit 101, so that the voltage of the first node N1 is equal to a sum of the voltage $V_{data}$ of the data signal and the first threshold voltage $V_{th1}$. That is, the voltage of the first node N1 is equal to $V_{data}+V_{th1}$. Since the gate of the driving transistor T1 is connected to the first node N1, a gate voltage of the driving transistor T1 is equal to the voltage of the first node N1. That is, the gate voltage of the driving transistor T1 is equal to $V_{data}+V_{th1}$. Therefore, a threshold voltage compensation on the driving transistor T1 is realized. In response to the enable signal received from the enable signal terminal EM, the first control sub-circuit 103 connects the first electrode of the driving transistor T1 to the first power supply voltage signal terminal VDD, and connects the second electrode of the driving transistor T1 to the element to be driven D. The first electrode of the driving transistor T1 is connected to the first power supply voltage signal terminal VDD. Therefore, a voltage of the first electrode of the driving transistor T1 is the voltage $V_{dd}$ of the first power supply voltage signal. In this way, in an example where the driving transistor T1 is a P-type transistor, the driving transistor T1 is turned on when a difference between the gate voltage $V_{data}+V_{th1}$ thereof and the voltage $V_{dd}$ of the first electrode thereof is less than the first threshold voltage thereof. That is, when $(V_{data}+V_{th1})-V_{dd}<V_{th1}$, the driving transistor T1 is turned on, and outputs the driving signal to the element to be driven D, so as to drive the element to be driven D to emit light.

$(V_{data}+V_{th1})-V_{dd}<V_{th1}$, i.e., $V_{data}-V_{dd}<0$, indicating that the turn-on of the driving transistor T1 is not affected by the first threshold voltage $V_{th1}$ thereof.

When a high mobility thin film transistor (for example, a low temperature polysilicon thin film transistor) is used as the driving transistor, since the high mobility thin film transistor is affected by a manufacturing process, a threshold voltage thereof usually has a certain deviation from a design value, which affects an operating stability of this type of thin film transistor. Accordingly, the driving signal is also affected.

In the driving control sub-circuit 10 provided by some embodiments of the present disclosure, since the threshold voltage compensation on the driving transistor T1 is performed, the driving signal output by the driving transistor T1 is unrelated to the first threshold voltage of the driving transistor T1, which is beneficial to ensure the operating stability of the driving transistor T1, and improves the brightness stability and the luminous efficiency of the element to be driven D. In addition, $V_{dd}$ may be designed as a constant value. In this way, the driving signal output by the driving transistor T1 may be controlled only according to $V_{data}$, which is simple and accurate, and is beneficial to reduce control errors.

For example, referring to FIG. 5, the driving control sub-circuit 10 includes the driving transistor T1, the first capacitor C1, the fourth transistor T4, the fifth transistor T5, the sixth transistor T6, and the seventh transistor T7.

The gate of the driving transistor T1 is connected to the first node N1, the first electrode of the driving transistor T1 is connected to the second electrode of the fourth transistor T4 and the second electrode of the sixth transistor T6, and the second electrode of the driving transistor T1 is connected to the first electrode of the fifth transistor T5 and the first electrode of the seventh transistor T7.

The end of the first capacitor C1 is connected to the first node N1, and the another end of the first capacitor C1 is connected to the first power supply voltage signal terminal VDD.

The gate of the fourth transistor T4 is connected to the scan signal terminal S, and the first electrode of the fourth transistor T4 is connected to the data signal terminal Data.

The gate of the fifth transistor T5 is connected to the scan signal terminal S, and the second electrode of the fifth transistor T5 is connected to the first node N1.

The gate of the sixth transistor T6 is connected to the enable signal terminal EM, and the first electrode of the sixth transistor T6 is connected to the first power supply voltage signal terminal VDD.

The gate of the seventh transistor T7 is connected to the enable signal terminal EM, and the second electrode of the seventh transistor T7 is connected to the first electrode of the element to be driven D.

Figure 6:
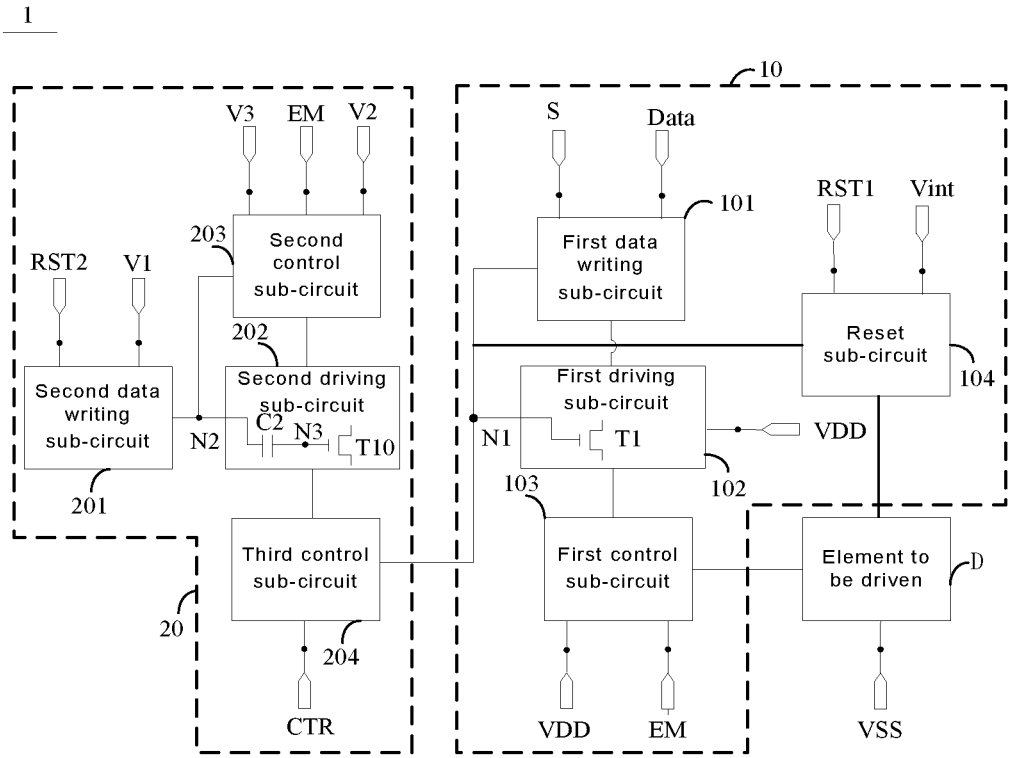
FIG. 6 is a structural block diagram of yet another pixel driving circuit, in accordance with some embodiments of the disclosure.

In yet other embodiments, as shown in FIG. 6, the driving control sub-circuit 10 further includes a reset sub-circuit 104.

The reset sub-circuit 104 is connected to a first reset signal terminal RST1, an initial signal terminal Vint, the first node N1, and the first electrode of the element to be driven D. The reset sub-circuit 104 is configured to, in response to a first reset signal received from the first reset signal terminal RST1, transmit an initial voltage signal provided from the initial signal terminal Vint to the first node N1 and the first electrode of the element to be driven D.

The embodiments of the present disclosure do not limit the magnitude of the initial voltage signal provided from the initial signal terminal Vint, so long as the initial voltage signal is able to ensure that the driving transistor T1 is in an off state when the reset sub-circuit 104 is operating. For example, a voltage of the initial voltage signal is a low voltage or a high voltage.

It will be noted that the high voltage and the low voltage in the embodiments of the present disclosure are relative, and a relatively high voltage of the two is referred to as the high voltage, and a relatively low voltage is the low voltage.

Since the first node N1 is connected to the gate of the driving transistor T1, and the gate voltage of the driving transistor T1 affects the driving signal, the driving signal affects the luminous brightness of the element to be driven D. In addition, the voltage of the first electrode of the element to be driven D also affects its own luminous brightness, thereby affecting the display effects. Therefore, in order to ensure the display effects, it is required to reset the voltage of the first node N1 and the voltage of the first electrode of the element to be driven D before display. The reset sub-circuit 104 provided by some embodiments of the present disclosure resets the voltage of the first node N1 and the voltage of the first electrode of the element to be driven D to an initial voltage provided from the initial signal terminal Vint, which is beneficial to ensure the display effects.

Figure 7:
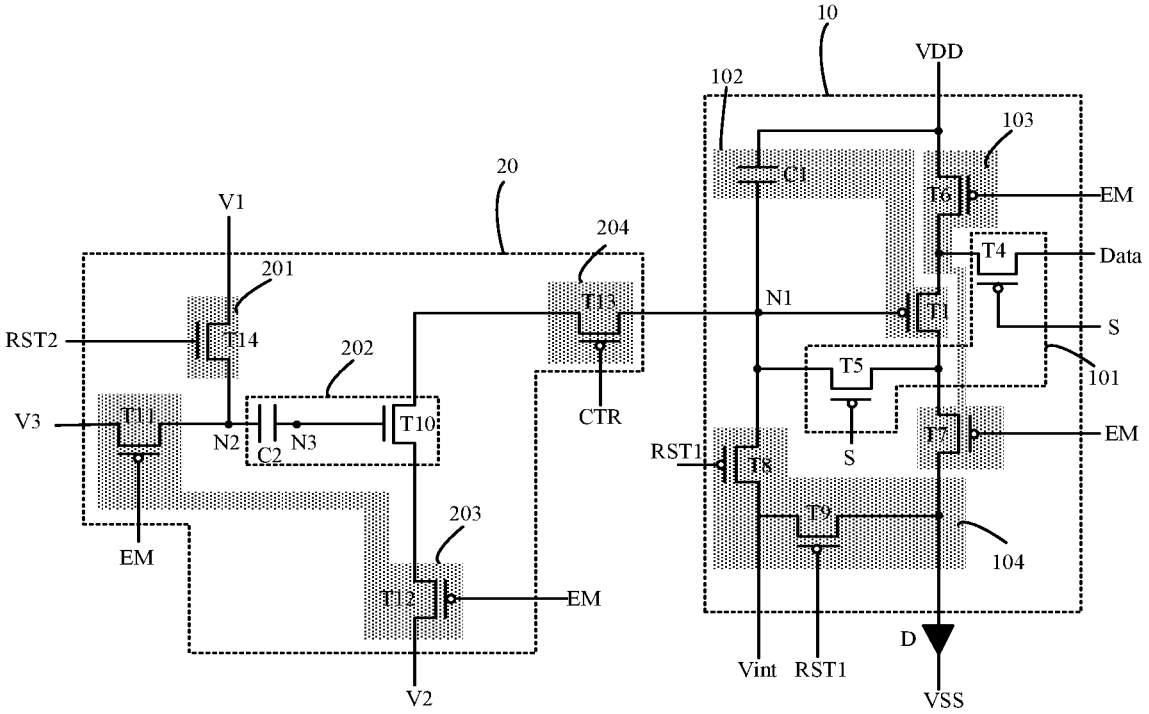
FIG. 7 is a schematic diagram showing a circuit configuration of yet another pixel driving circuit, in accordance with some embodiments of the present disclosure.

In some examples, as shown in FIG. 7, the reset sub-circuit 104 includes an eighth transistor T8 and a ninth transistor T9.

A gate of the eighth transistor T8 is connected to the first reset signal terminal RST1, a first electrode of the eighth transistor T8 is connected to the initial signal terminal Vint, and a second electrode of the eighth transistor T8 is connected to the first node N1. The eighth transistor T8 is configured to be turned on in response to the first reset signal received from the first reset signal terminal RST1, so that the initial voltage signal provided from the initial signal terminal Vint is transmitted to the first node N1, so as to reset the voltage of the first node N1 to the initial voltage provided from the initial signal terminal Vint.

A gate of the ninth transistor T9 is connected to the first reset signal terminal RST1, a first electrode of the ninth transistor T9 is connected to the initial signal terminal Vint, and a second electrode of the ninth transistor T9 is connected to the first electrode of the element to be driven D. The ninth transistor T9 is configured to be turned on in response to the first reset signal received from the first reset signal terminal RST1, so that the initial voltage signal provided from the initial signal terminal Vint is transmitted to the first electrode of the element to be driven D, so as to reset the voltage of the first electrode of the element to be driven D to the initial voltage provided from the initial signal terminal Vint.

For example, referring to FIG. 7, the driving control sub-circuit 10 including the reset sub-circuit 104 includes the driving transistor T1, the fourth transistor T4, the fifth transistor T5, the sixth transistor T6, the seventh transistor T7, the eighth transistor T8, the ninth transistor T9, and the first capacitor C1.

The gate of the driving transistor T1 is connected to the first node N1, the first electrode of the driving transistor T1 is connected to the second electrode of the fourth transistor T4 and the second electrode of the sixth transistor T6, and the second electrode of the driving transistor T1 is connected to the first electrode of the fifth transistor T5 and the first electrode of the seventh transistor T7.

The end of the first capacitor C1 is connected to the first node N1, and the another end of the first capacitor C1 is connected to the first power supply voltage signal terminal VDD.

The gate of the fourth transistor T4 is connected to the scan signal terminal S, and the first electrode of the fourth transistor T4 is connected to the data signal terminal Data.

The gate of the fifth transistor T5 is connected to the scan signal terminal S, and the second electrode of the fifth transistor T5 is connected to the first node N1.

The gate of the sixth transistor T6 is connected to the enable signal terminal EM, and the first electrode of the sixth transistor T6 is connected to the first power supply voltage signal terminal VDD.

The gate of the seventh transistor T7 is connected to the enable signal terminal EM, and the second electrode of the seventh transistor T7 is connected to the first electrode of the element to be driven D.

The gate of the eighth transistor T8 is connected to the first reset signal terminal RST1, the first electrode of the eighth transistor T8 is connected to the initial signal terminal Vint, and the second electrode of the eighth transistor T8 is connected to the first node N1.

The gate of the ninth transistor T9 is connected to the first reset signal terminal RST1, the first electrode of the ninth transistor T9 is connected to the initial signal terminal Vint, and the second electrode of the ninth transistor T9 is connected to the first electrode of the element to be driven D.

The driving transistor T1, the fourth transistor T4, the fifth transistor T5, the sixth transistor T6, the seventh transistor T7, the eighth transistor T8, and the ninth transistor T9 are all P-type transistors.

In some embodiments, as shown in FIGS. 2 and 3, the driving duration control sub-circuit 20 includes a second data writing sub-circuit 201, the second driving sub-circuit 202, a second control sub-circuit 203, and a third control sub-circuit 204.

The second driving sub-circuit 202 includes a tenth transistor T10 and a second capacitor C2. An end of the second capacitor C2 is connected to the second node N2, and another end of the second capacitor C2 is connected to a third node N3. A gate of the tenth transistor T10 is connected to the third node N3.

The second data writing sub-circuit 201 is connected to the second reset signal terminal RST2, the first voltage signal terminal V1, and the second node N2. The second data writing sub-circuit 201 is configured to, in response to the second reset signal received from the second reset signal terminal RST2, write the first voltage signal provided from the first voltage signal terminal V1 into the second node N2.

The second control sub-circuit 203 is connected to the enable signal terminal EM, the second voltage signal terminal V2, the third voltage signal terminal V3, the second node N2, and the tenth transistor T10. The second control sub-circuit 203 is configured to, in response to the enable signal received from the enable signal terminal EM, write the third voltage signal changing within the set voltage range that is provided from the third voltage signal terminal V3 into the second node N2, and connect the tenth transistor T10 to the second voltage signal terminal V2.

The third control sub-circuit 204 is connected to the control signal terminal CTR, the tenth transistor T10, and the first node N1. The third control sub-circuit 204 is configured to connect the tenth transistor T10 to the first node N1 in response to the control signal received from the control signal terminal CTR.

In some examples, as shown in FIGS. 4, 5, 7, 10, 11, and 12, a first electrode of the tenth transistor T10 is connected to the second control sub-circuit 203, and a second electrode of the tenth transistor T10 is connected to the third control sub-circuit 204.

The tenth transistor T10 is configured to be turned on in response to a voltage variation between the third voltage signal and the first voltage signal at the second node N2, so that the second voltage signal provided from the second voltage signal terminal V2 is transmitted to the third control sub-circuit 204.

The second capacitor C2 is configured to receive and store the first voltage signal provided from the first voltage signal terminal V1 and written by the second data writing sub-circuit 201, and receive and store the third voltage signal changing within the reset voltage range that is written by the second control sub-circuit 203.

In some examples, as shown in FIGS. 4, 5, 7, 10, 11, and 12, the second control sub-circuit 203 includes an eleventh transistor T11 and a twelfth transistor T12.

A gate of the eleventh transistor T11 is connected to the enable signal terminal EM, a first electrode of the eleventh transistor T11 is connected to the third voltage signal terminal V3, and a second electrode of the eleventh transistor T11 is connected to the second node N2.

The eleventh transistor T11 is configured to be turned on in response to the enable signal received from the enable signal terminal EM, so that the third voltage signal provided from the third voltage signal terminal V3 is transmitted to the second node N2. The third voltage signal provided from the third voltage signal terminal V3 changes within the set voltage range, and the set voltage range is determined according to the luminous duration of the element to be driven D and the data signal provided from the data signal terminal Data.

A gate of the twelfth transistor T12 is connected to the enable signal terminal EM, a first electrode of the twelfth transistor T12 is connected to the second voltage signal terminal V2, and a second electrode of the twelfth transistor T12 is connected to the first electrode of the tenth transistor T10.

The twelfth transistor T12 is configured to be turned on in response to the enable signal received from the enable signal terminal EM, so that the first electrode of the tenth transistor T10 is connected to the second voltage signal terminal V2, so as to transmit the second voltage signal provided from the second voltage signal terminal V2 to the first electrode of the tenth transistor T10.

In some examples, as shown in FIGS. 4, 5, 7, 10, 11, and 12, the third control sub-circuit 204 includes a thirteenth transistor T13.

A gate of the thirteenth transistor T13 is connected to the control signal terminal CTR, a first electrode of the thirteenth transistor T13 is connected to the second electrode of the tenth transistor T10, and a second electrode of the thirteenth transistor T13 is connected to the first node N1.

The thirteenth transistor T13 is configured to be turned on in response to the control signal received from the control signal terminal CTR, so that the second electrode of the tenth transistor T10 is connected to the first node N1, so as to transmit the second voltage signal to the first node N1 when the tenth transistor T10 is turned on.

The second voltage signal transmitted to the first node N1 is configured to stop the first driving sub-circuit 102 from outputting the driving signal. That is, in a case where the first driving sub-circuit 102 includes the driving transistor T1, and the driving transistor T1 is configured to output the driving signal according to the data signal provided from the data signal terminal Data and the first power supply voltage signal provided from the first power supply voltage signal terminal VDD, the second voltage signal is configured to make the driving transistor T1 be turned off. The driving transistor T1 is turned off, so that the element to be driven D changes from a light-emitting state to a non-light-emitting state.

In some examples, as shown in FIGS. 4, 5, and 7, the second data writing sub-circuit 201 includes a fourteenth transistor T14.

A gate of the fourteenth transistor T14 is connected to the second reset signal terminal RST2, a first electrode of the fourteenth transistor T14 is connected to the first voltage signal terminal V1, and a second electrode of the fourteenth transistor T14 is connected to the second node N2.

The fourteenth transistor T14 is configured to be turned on in response to the second reset signal received from the second reset signal terminal RST2, so that the first voltage signal provided from the first voltage signal terminal V1 is transmitted to the second node N2. Since the two ends of the second capacitor C2 are respectively connected to the second node N2 and the third node N3, and a voltage of the third node N3 is equal to 0, the two ends of the second capacitor C2 have a voltage difference therebetween, and the voltage difference is equal to a voltage of the first voltage signal.

In the driving duration control sub-circuit 20, since the gate of the tenth transistor T10 is connected to the third node N3, a gate voltage of the tenth transistor T10 is equal to the voltage of the third node N3. After the fourteenth transistor T14 is turned on, the first voltage signal is transmitted to the second node N2, so that the voltage difference is present between the two ends of the second capacitor C2. That is, the voltage difference is present between the second node N2 and the third node N3. As described above, the voltage difference is the voltage (denoted as $V_{com1}$) of the first voltage signal. According to the law of conservation of charge of the capacitor, when the third voltage signal provided from the third voltage signal terminal V3 is transmitted to the second node N2, the voltage of the second node N2 changes. That is, the voltage of the second node N2 changes from the voltage $V_{com1}$ of the first voltage signal to a voltage (denoted as $V_x$) of the third voltage signal. In this case, the voltage of the third node N3 changes as the voltage of the second node N2 changes. That is, the difference between the voltage $V_x$ provided from the third voltage signal terminal V3 and the voltage $V_{com1}$ provided from the first voltage signal terminal V1 is superimposed on the voltage of the third node N3. That is, the voltage of the third node N3 changes from 0 to $V_x-V_{com1}$.

After the thirteenth transistor T13 is turned on, the tenth transistor T10 is connected to the first node N1. Thus, before the tenth transistor T10 is turned on, a voltage of the second electrode of the tenth transistor T10 is equal to the voltage of the first node N1. The voltage of the first node N1 is related to the data signal provided from the data signal terminal Data. Taking the pixel driving circuit shown in FIG. 5 or FIG. 7 as an example, the driving control sub-circuit 10 includes the fourth transistor T4 and the fifth transistor T5, and the voltage of the first node N1 is equal to $V_{data}+V_{th1}$.

In an example where the tenth transistor T10 is an N-type transistor, when a difference between the gate voltage of the tenth transistor T10 and the voltage of the second electrode thereof is greater than a second threshold voltage $V_{th2}$ of the tenth transistor T10 (that is, the voltage difference between the voltage of the third node N3 and the voltage of the first node N1 is greater than the second threshold voltage $V_{th2}$ of the tenth transistor T10), the tenth transistor T10 is turned on. After the tenth transistor T10 is turned on, the second voltage signal is transmitted to the first node N1, which leads to a change in the voltage of the first node N1. That is, the voltage of the first node N1 will become the voltage of the second voltage signal, so that the driving transistor T1 is turned off. For example, in a case where the driving transistor T1 is a P-type transistor, when the voltage of the second voltage signal is the high voltage, the driving transistor T1 is turned off.

Taking the pixel driving circuit shown in FIG. 5 or FIG. 7 as an example, the voltage of the first node N1 is $V_{data}+V_{th1}$. In a case where the tenth transistor T10 is an N-type transistor, when $(V_x-V_{com1})-(V_{data}+V_{th1})>V_{th2}$, i.e., when $V_x-V_{data}>V_{com1}+V_{th1}+V_{th2}$, the tenth transistor T10 is turned on.

Figure 8:
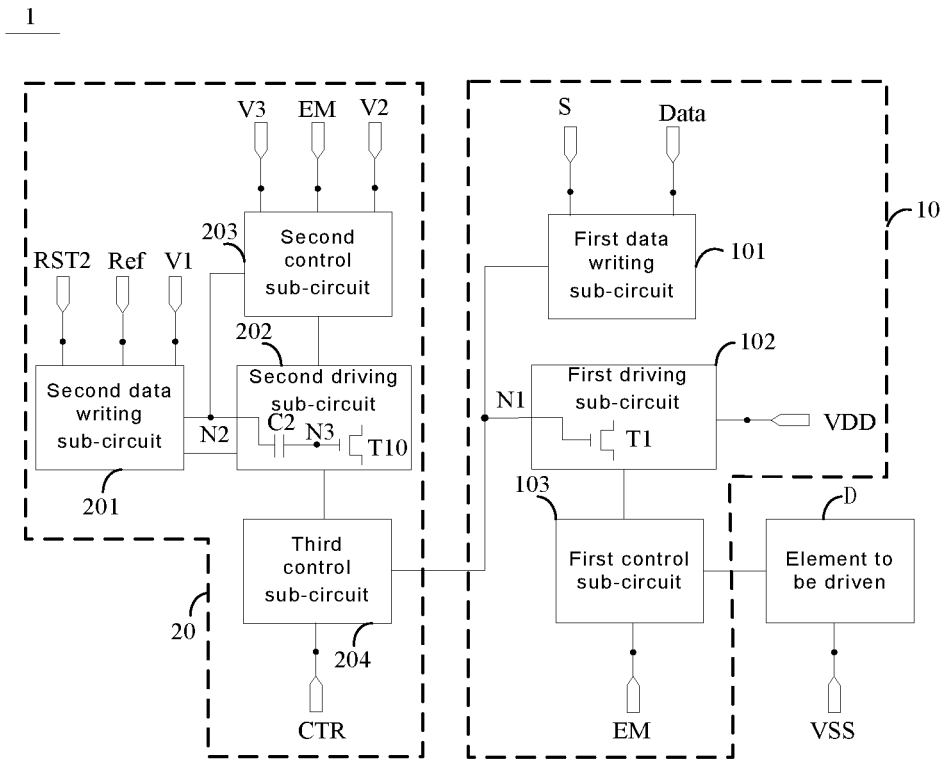
FIG. 8 is a structural block diagram of yet another pixel driving circuit, in accordance with some embodiments of the present disclosure.
Figure 9:
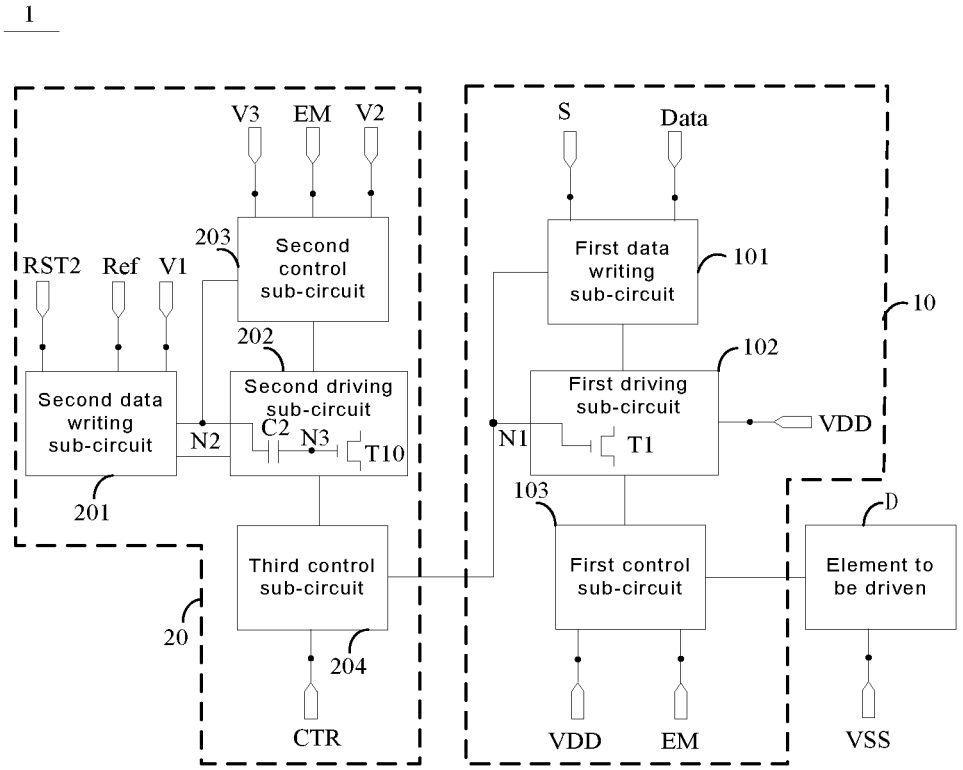
FIG. 9 is a structural block diagram of yet another pixel driving circuit, in accordance with some embodiments of the present disclosure.

In some other embodiments, as shown in FIGS. 8 and 9, the driving duration control sub-circuit 20 includes a second data writing sub-circuit 201, the second driving sub-circuit 202, a second control sub-circuit 203, and a third control sub-circuit 204.

The second driving sub-circuit 202 includes a tenth transistor T10 and a second capacitor C2. An end of the second capacitor C2 is connected to the second node N2, and another end of the second capacitor C2 is connected to a third node N3. A gate of the tenth transistor T10 is connected to the third node N3.

The second data writing sub-circuit 201 is connected to the second reset signal terminal RST2, the first voltage signal terminal V1, the second node N2, a reference voltage signal terminal Ref, and the tenth transistor T10. The second data writing sub-circuit 201 is configured to, in response to the second reset signal received from the second reset signal terminal RST2, write the first voltage signal provided from the first voltage signal terminal V1 into the second node N2, and write a reference voltage signal provided from the reference voltage signal terminal Ref into the third node N3.

The second control sub-circuit 203 is connected to the enable signal terminal EM, the second voltage signal terminal V2, the third voltage signal terminal V3, the second node N2, and the tenth transistor T10. The second control sub-circuit 203 is configured to, in response to the enable signal received from the enable signal terminal EM, write the third voltage signal changing within the set voltage range that is provided from the third voltage signal terminal V3 into the second node N2, and connect the tenth transistor T10 to the second voltage signal terminal V2.

The third control sub-circuit 204 is connected to the control signal terminal CTR, the tenth transistor T10, and the first node N1. The third control sub-circuit 204 is configured to connect the tenth transistor T10 to the first node N1 in response to the control signal received from the control signal terminal CTR.

The tenth transistor T10 is configured to transmit the second voltage signal provided from the second voltage signal terminal V2 to the first node N1 in response to a voltage variation between the third voltage signal and the first voltage signal at the second node N2.

Here, respective configurations and corresponding connection relationships of the second driving sub-circuit 202, the second control sub-circuit 203, and the third control sub-circuit 204 may respectively refer to configurations and corresponding connection relationships of the second driving sub-circuit 202, the second control sub-circuit 203, and the third control sub-circuit 204 in the driving duration control sub-circuit 20 described above, which will not be repeated here.

Figure 10:
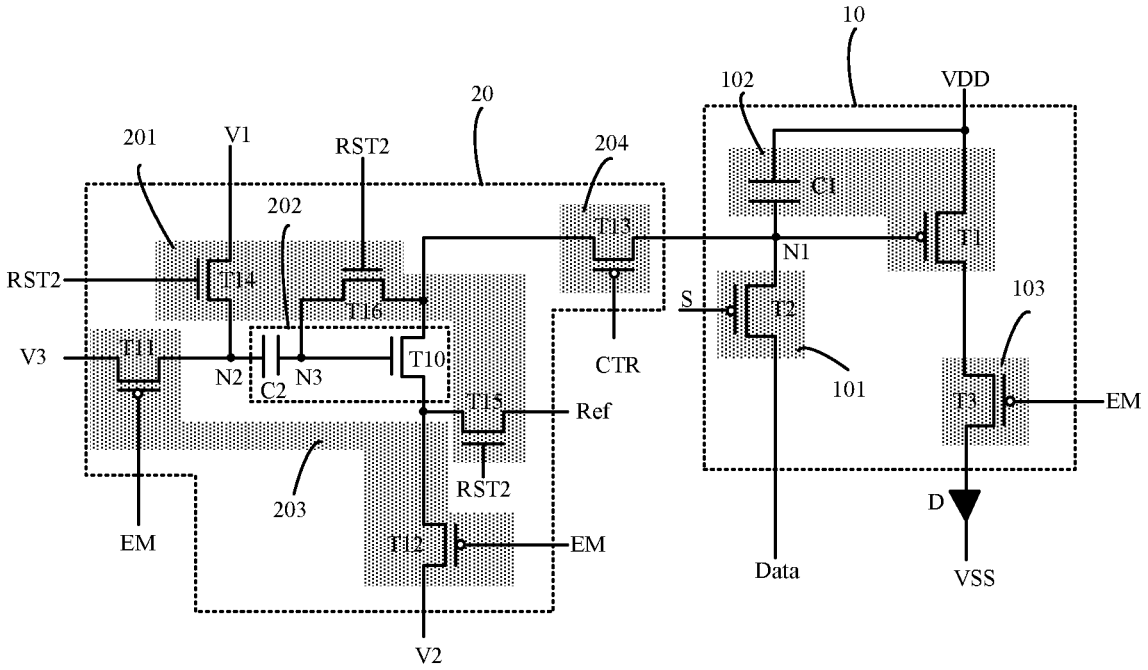
FIG. 10 is a schematic diagram showing a circuit configuration of yet another pixel driving circuit, in accordance with some embodiments of the present disclosure.
Figure 11:
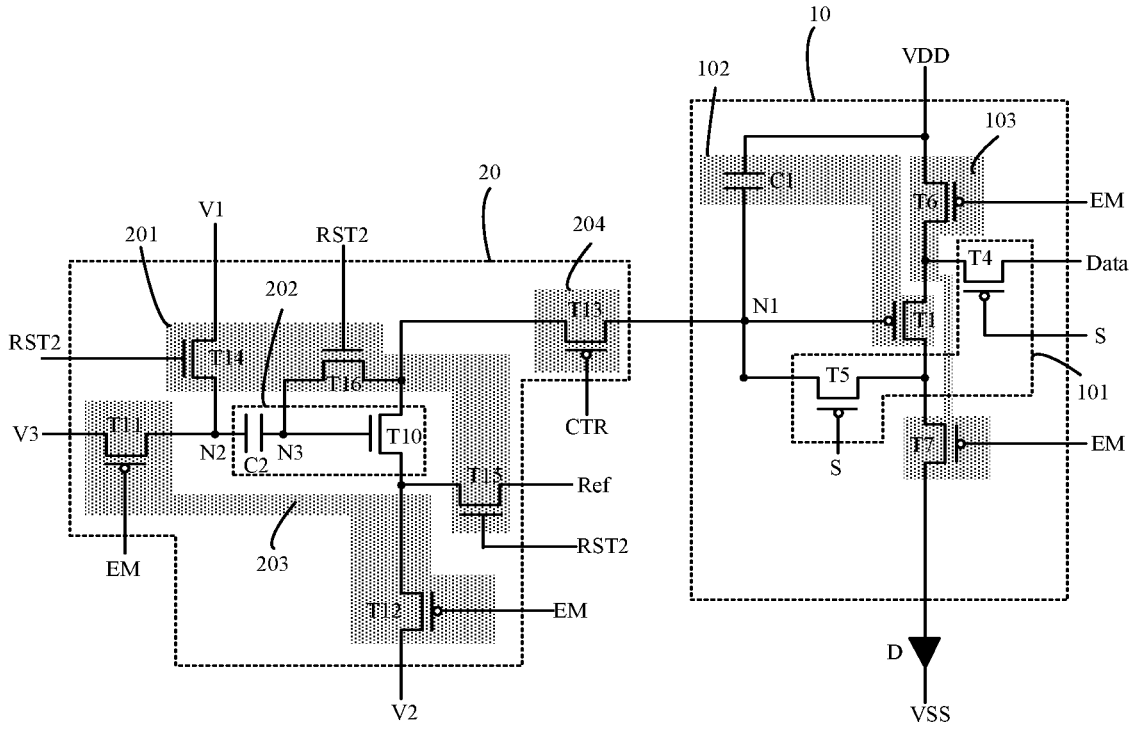
FIG. 11 is a schematic diagram showing a circuit configuration of yet another pixel driving circuit, in accordance with some embodiments of the present disclosure.
Figure 12:
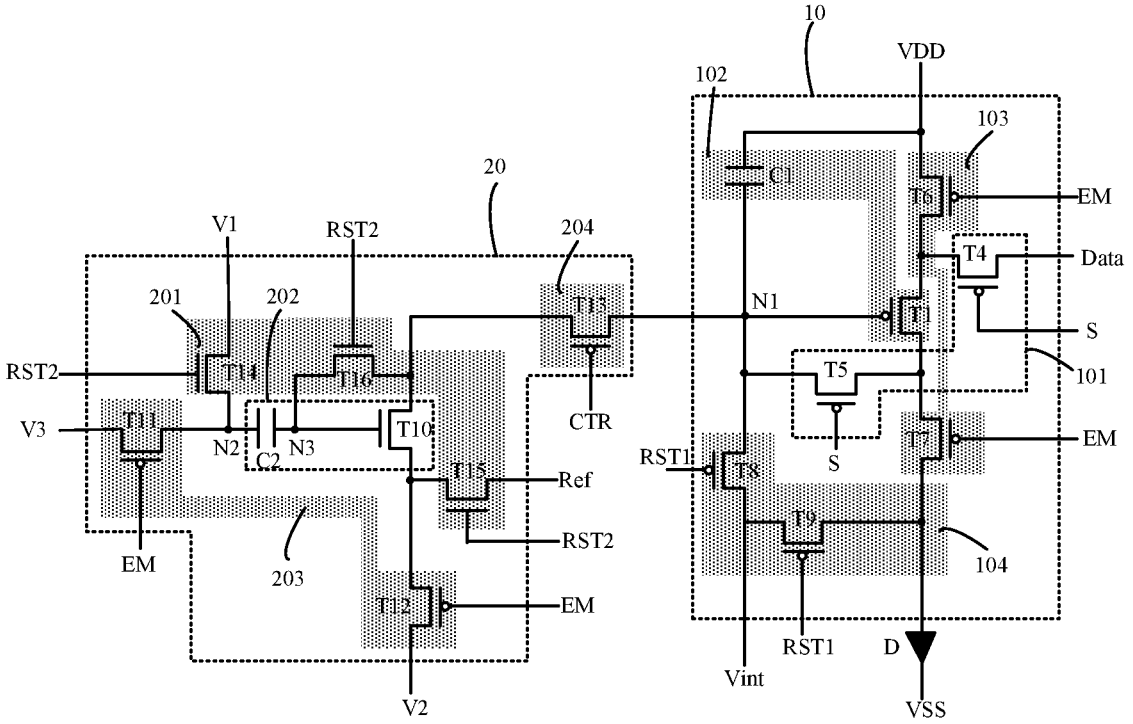
FIG. 12 is a schematic diagram showing a circuit configuration of yet another pixel driving circuit, in accordance with some embodiments of the present disclosure.

In some examples, as shown in FIGS. 10 to 12, the second data writing sub-circuit 201 includes a fourteenth transistor T14, a fifteenth transistor T15, and a sixteenth transistor T16.

A gate of the fourteenth transistor T14 is connected to the second reset signal terminal RST2, a first electrode of the fourteenth transistor T14 is connected to the first voltage signal terminal V1, and a second electrode of the fourteenth transistor T14 is connected to the second node N2.

A gate of the fifteenth transistor T15 is connected to the second reset signal terminal RST2, a first electrode of the fifteenth transistor T15 is connected to the reference voltage signal terminal Ref, and a second electrode of the fifteenth transistor T15 is connected to a first electrode of the tenth transistor T10.

A gate of the sixteenth transistor T16 is connected to the second reset signal terminal RST2, a first electrode of the sixteenth transistor T16 is connected to a second electrode of the tenth transistor T10, and a second electrode of the sixteenth transistor T16 is connected to the third node N3.

In the driving duration control sub-circuit 20, the fourteenth transistor T14 is configured to be turned on in response to the second reset signal received from the second reset signal terminal RST2, so that the first voltage signal provided from the first voltage signal terminal V1 is transmitted to the second node N2. In this case, the voltage of the second node N2 is the voltage $V_{com1}$ of the first voltage signal.

The fifteenth transistor T15 and the sixteenth transistor T16 are configured to be turned on in response to the second reset signal received from the second reset signal terminal RST2, so that the reference voltage signal provided from the reference voltage signal terminal Ref and the second threshold voltage of the tenth transistor T10 are written into the third node N3. That is, a voltage of the third node N3 is equal to $V_{th2}+V_{Ref}$, $V_{th2}$ is the second threshold voltage, and $V_{Ref}$ is a voltage of the reference voltage signal. In this case, a voltage difference between the two ends of the second capacitor C2 is $V_{com1}-(V_{th2}+V_{Ref})$.

When the third voltage signal provided from the third voltage signal terminal V3 is transmitted to the second node N2, the voltage of the second node N2 changes from the voltage $V_{com1}$ of the first voltage signal to the voltage $V_x$ of the third voltage signal. According to the law of conservation of charge of the capacitor, the voltage of the third node N3 changes from $V_{th2}+V_{Ref}$ to $V_{th2}+V_{Ref}+(V_x-V_{com1})$.

Since the gate of the tenth transistor T10 is connected to the third node N3, the gate voltage of the tenth transistor T10 is equal to the voltage of the third node N3. That is, the gate voltage of the tenth transistor T10 is $V_{th2}+V_{Ref}+(V_x-V_{com1})$. Taking the pixel driving circuit shown in FIG. 11 or FIG. 12 as an example, the driving control sub-circuit 10 includes the fourth transistor T4 and the fifth transistor T5, and the voltage of the first node N1 is $V_{data}+V_{th1}$. In the case where the tenth transistor T10 is the N-type transistor, when $V_{th2}+V_{Ref}+(V_x-V_{com1})-(V_{data}+V_{th1})>V_{th2}$, i.e., $V_{Ref}+(V_x-V_{com1})-(V_{data}+V_{th1})>0$, the tenth transistor T10 is turned on. In this case, the turn-on of the tenth transistor T10 is not affected by the second threshold voltage $V_{th2}$ thereof, which may improve the operating stability of the tenth transistor T10, and is conducive to accurately controlling the turn-off of the driving transistor T1, so as to accurately control the operating duration of the element to be driven D and reduce the control errors.

In some examples, $V_{com1}$ and $V_{Ref}$ are set to 0 V, and $V_{Ref}+(V_x-V_{com1})-(V_{data}+V_{th1})>0$ may be simplified to $V_x-V_{data}>V_{th1}$.

After the tenth transistor T10 is turned on, the second voltage signal is transmitted to the first node N1, which leads to the change in the voltage of the first node N1. That is, the voltage of the first node N1 becomes the voltage of the second voltage signal, so that the driving transistor T1 is turned off.

In the case where the tenth transistor T10 is the N-type transistor, since the turn-on of the tenth transistor T10 is affected by the first voltage signal provided from the first voltage signal terminal V1, the reference voltage signal provided from the reference voltage signal terminal Ref, the third voltage signal provided from the third voltage signal terminal V3, and the data signal provided from the data signal terminal Data, and the first voltage signal provided from the first voltage signal terminal V1 and the reference voltage signal provided from the reference voltage signal terminal Ref may be set as constant values, the turn-on of the tenth transistor T10 is determined by the third voltage signal provided from the third voltage signal terminal V3 and the data signal provided from the data signal terminal Data. In other words, in a case where different data signals are input to the pixel driving circuits 1 located in different sub-pixel regions, for each pixel driving circuit, when the voltage of the third voltage signal changes to a certain voltage, the tenth transistor T10 in the pixel driving circuit is turned on, thereby controlling the operating duration of the element to be driven D in the sub-pixel region.

The voltage $V_x$ of the third voltage signal terminal V3 is a floating value. The set voltage range of the third voltage signal is, for example, $V_a$ to $V_b$, and any voltage value within the range of $V_a$ to $V_b$ is $V_c$, i.e., $V_a \leq V_c \leq V_b$. Starting from the enable signal terminal EM outputting an effective signal, i.e., from a moment when the element to be driven D starts to emit light, in a process of the voltage $V_x$ of the third voltage signal changing from $V_a$ to $V_b$, at a certain moment, a difference value between the voltage $V_c$ of the third voltage signal and the voltage $V_{data}$ of the data signal enables the tenth transistor T10 to be turned on, so that the second voltage signal provided from the second voltage signal terminal V2 is transmitted to the first node N1, so as to control the driving transistor T1 to be turned off. In this case, the operating duration of the element to be driven D is equal to a time span during which the voltage $V_x$ of the third voltage signal changes from $V_a$ to $V_c$.

For different $V_{data}$, values of $V_c$ that correspond to different $V_{data}$ and are able to turn on the tenth transistor T10 may be determined. Then, according to the operating duration of the element to be driven D, the values of $V_a$ and $V_b$ may be determined, thereby obtaining the set voltage range of the third voltage signal.

The driving duration control sub-circuit 20 may turn on the tenth transistor T10 when the voltage of the third voltage signal changes to a certain voltage by receiving the third voltage signal changing within the set voltage range from the third voltage signal terminal V3, so that the second voltage signal provided from the second voltage signal terminal V2 is transmitted to the first node N1, so as to control the driving transistor T1 to be turned off. Thus, it is realized that the driving duration control sub-circuit 20 controls the operating duration of the element to be driven D.

In some examples, as shown in FIGS. 10, 11, and 12, the driving duration control sub-circuit 20 includes the tenth transistor T10, the eleventh transistor T11, the twelfth transistor T12, the thirteenth transistor T13, the fourteenth transistor T14, the fifteenth transistor T15, the sixteenth transistor T16, and the second capacitor C2.

The gate of the tenth transistor T10 is connected to the third node N3, the first electrode of the tenth transistor T10 is connected to the second electrode of the twelfth transistor T12 and the second electrode of the fifteenth transistor T15, and the second electrode of the tenth transistor T10 is connected to the first electrode of the sixteenth transistor T16 and the first electrode of the thirteenth transistor T13.

The end of the second capacitor C2 is connected to the second node N2, and the another end of the second capacitor C2 is connected to the third node N3.

The gate of the eleventh transistor T11 is connected to the enable signal terminal EM, the first electrode of the eleventh transistor T11 is connected to the third voltage signal terminal V3, and the second electrode of the eleventh transistor T11 is connected to the second node N2.

The gate of the twelfth transistor T12 is connected to the enable signal terminal EM, and the first electrode of the twelfth transistor T12 is connected to the second voltage signal terminal V2.

The gate of the thirteenth transistor T13 is connected to the control signal terminal CTR, and the second electrode of the thirteenth transistor T13 is connected to the first node N1.

The gate of the fourteenth transistor T14 is connected to the second reset signal terminal RST2, the first electrode of the fourteenth transistor T14 is connected to the first voltage signal terminal V1, and the second electrode of the fourteenth transistor T14 is connected to the second node N2.

The gate of the fifteenth transistor T15 is connected to the second reset signal terminal RST2, and the first electrode of the fifteenth transistor T15 is connected to the reference voltage signal terminal Ref.

The gate of the sixteenth transistor T16 is connected to the second reset signal terminal RST2, and the second electrode of the sixteenth transistor T16 is connected to the third node N3.

The tenth transistor T10, the fourteenth transistor T14, the fifteenth transistor T15, and the sixteenth transistor T16 are all N-type transistors, and the eleventh transistor T11, the twelfth transistor T12, and the thirteenth transistor T13 are all P-type transistors. Or, the tenth transistor T10, the fourteenth transistor T14, the fifteenth transistor T15, and the sixteenth transistor T16 are all P-type transistors, and the eleventh transistor T11, the twelfth transistor T12, and the thirteenth transistor T13 are all N-type transistors.

Figure 13:
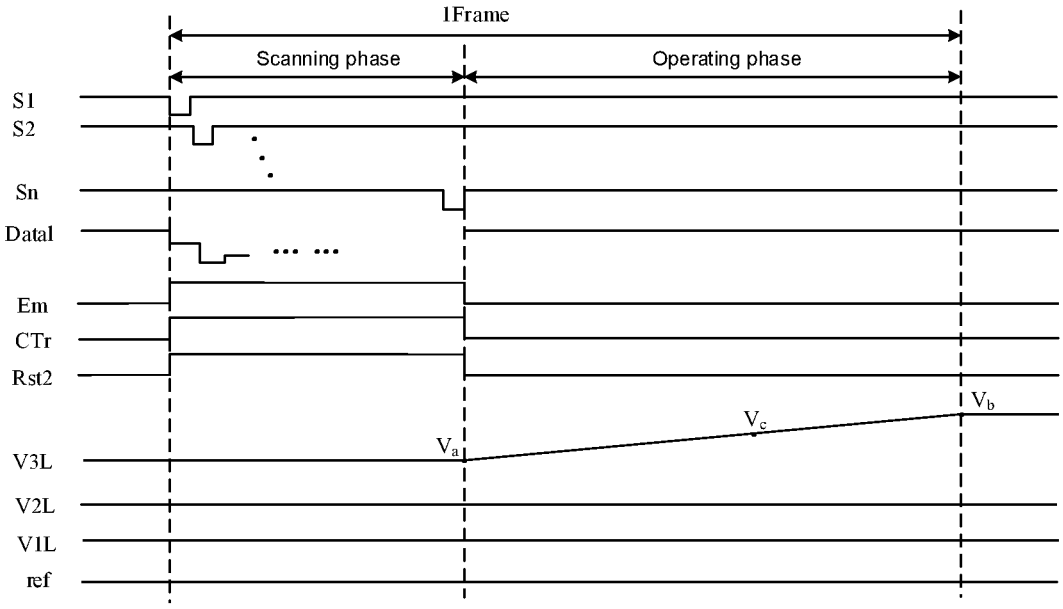
FIG. 13 is a schematic timing diagram of a pixel driving circuit, in accordance with some embodiments of the present disclosure.
Figure 14:
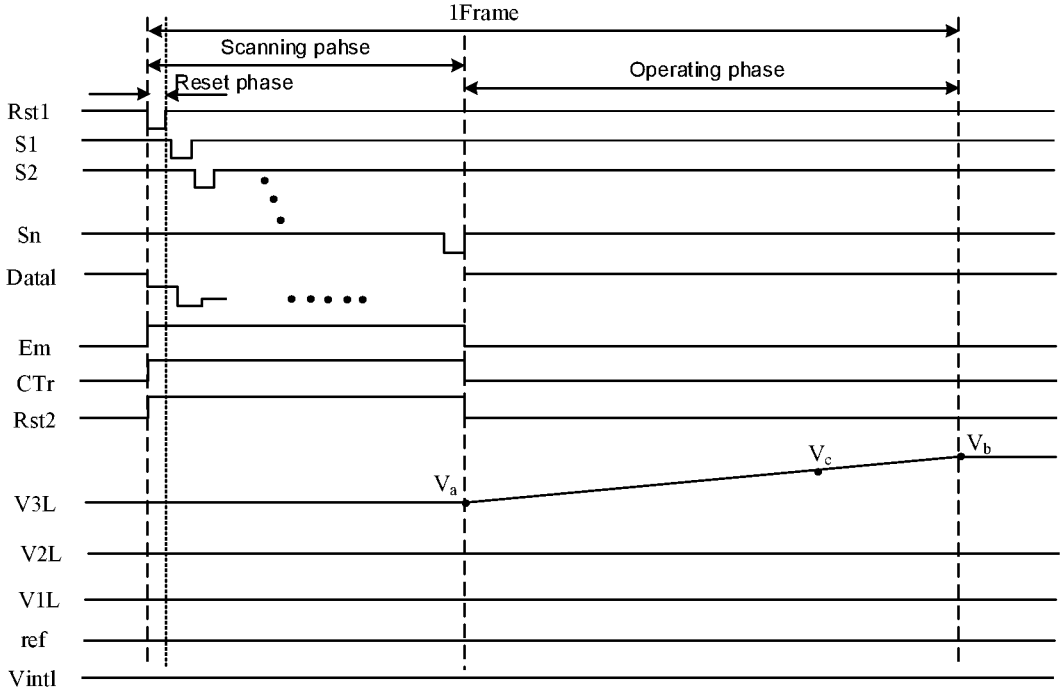
FIG. 14 is a schematic timing diagram of another pixel driving circuit, in accordance with some embodiments of the present disclosure.

Some embodiments of the present disclosure further provide a driving method of the pixel driving circuit. As shown in FIGS. 13 and 14, a frame period (1 Frame) includes a scanning phase and an operating phase, and the scanning phase includes a plurality of row scanning phases. For example, the plurality of row scanning phases include N row scanning phases, and N is a positive integer. Each row scanning phase includes S10 and S20, and the operating phase includes S30 and S40.

The driving method includes the following steps.

1. In each of the plurality of row scanning phases:

in S10, the driving control sub-circuit 10 writes at least the data signal from the data signal terminal Data into the first node N1 in response to the scan signal received from the scan signal terminal S, and in S20, the driving duration control sub-circuit 20 writes the first voltage signal from the first voltage signal terminal V1 into the second node N2 in response to the second reset signal received from the second reset signal terminal RST2.

2. In the operating phase:

in S30, in response to the enable signal received from the enable signal terminal EM, the driving control sub-circuit 10 enables the first driving sub-circuit 102 to output the driving signal according to the data signal provided from the data signal terminal Data and the first power supply voltage signal provided from the first power supply voltage signal terminal VDD, so as to drive the element to be driven D to operate; and in S40, in response to the enable signal received from the enable signal terminal EM and the control signal received from the control signal terminal CTR, the driving duration control sub-circuit 20 writes the third voltage signal changing within the set voltage range from the third voltage signal terminal V3 into the second node N2; and in response to the voltage variation between the third voltage signal and the first voltage signal, the driving duration control sub-circuit 20 transmits the second voltage signal provided from the second voltage signal terminal V2 to the first node N1, so that the first driving sub-circuit 102 stops outputting the driving signal to control the operating duration of the element to be driven D.

In some embodiments, as shown in FIG. 2, the driving control sub-circuit 10 includes the first data writing sub-circuit 101, the first driving sub-circuit 102, and the first control sub-circuit 103. The first data writing sub-circuit 101 is connected to the scan signal terminal S, the data signal terminal Data, and the first node N1. The first driving sub-circuit 102 includes the driving transistor T1, and the first driving sub-circuit 102 is connected to the first node N1 and the first power supply voltage signal terminal VDD. The first control sub-circuit 103 is connected to the enable signal terminal EM, the second electrode of the driving transistor T1, and the element to be driven D.

Referring to FIGS. 2 and 13, S10 and S30 described above include S101 and S301, respectively.

In S101, in each of the plurality of row scanning phases, the first data writing sub-circuit 101 writes the data signal from the data signal terminal Data into the first node N1 in response to the scan signal received from the scan signal terminal S.

In S301, in the operating phase, the driving transistor T1 outputs the driving signal according to the data signal provided from the data signal terminal Data and the first power supply voltage signal provided from the first power supply voltage signal terminal VDD. In response to the enable signal received from the enable signal terminal EM, the first control sub-circuit 103 connects the second electrode of the driving transistor T1 to the element to be driven D, so that the driving signal is transmitted to the element to be driven D to drive the element to be driven D to operate.

For example, as shown in FIG. 4, the first data writing sub-circuit 101 includes the second transistor T2. The first driving sub-circuit 102 includes the driving transistor T1 and the first capacitor C1. The first control sub-circuit 103 includes the third transistor T3. The connection modes between the driving transistor T1, the first capacitor C1, the second transistor T2, and the third transistor T3 refer to the above description, which will not be repeated here.

Based on this, referring to FIGS. 4 and 13, S101 and S301 described above include S1011 and S3011, respectively.

In S1011, in each of the plurality of row scanning phases, the second transistor T2 is turned on in response to the scan signal received from the scan signal terminal S, so that the data signal provided from the data signal terminal Data is transmitted to the first node N1.

After each scanning phase is over, the voltage of the first node N1 is the voltage $V_{data}$ of the data signal. That is, the gate voltage of the driving transistor T1 is equal to $V_{data}$. The voltage of the first electrode of the driving transistor T1 is equal to the voltage $V_{dd}$ of the first power supply voltage signal provided from the first power supply voltage signal terminal VDD. Since the end of the first capacitor C1 is connected to the first node N1, a voltage at the end of the first capacitor C1 is the voltage of the first node N1, i.e., $V_{data}$. The another end of the first capacitor C1 is connected to the first power supply voltage signal terminal VDD, and thus, a voltage at the another end of the first capacitor C1 is the voltage $V_{dd}$ of the first power supply voltage signal. It can be seen from the above that the voltages at the two ends of the first capacitor C1 are $V_{data}$ and $V_{dd}$, respectively, and the two are not equal. That is, the voltage difference is present between the two ends of the first capacitor C1. Therefore, the first capacitor C1 is charged.

In S3011, in the operating phase, the driving transistor T1 outputs the driving signal according to the data signal stored in the first capacitor C1 and the first power supply voltage signal provided from the first power supply voltage signal terminal VDD. The third transistor T3 is turned on in response to the enable signal received from the enable signal terminal EM, so that the second electrode of the driving transistor T1 is connected to the first electrode of the element to be driven D.

In a case where the driving transistor T1 is a P-type transistor, when a difference between the gate voltage $V_{data}$ of the driving transistor T1 and the voltage $V_{dd}$ of the first electrode thereof is less than the first threshold voltage $V_{th1}$ of the driving transistor T1, the driving transistor T1 is in an on state, and outputs the driving signal to the element to be driven D, so that the element to be driven D emits light.

In some other embodiments, as shown in FIG. 3, the driving control sub-circuit 10 includes the first data writing sub-circuit 101, the first driving sub-circuit 102, and the first control sub-circuit 103. The first driving sub-circuit 102 includes the driving transistor T1. The first data writing sub-circuit 101 is connected to the scan signal terminal S, the data signal terminal Data, the first node N1, and the first electrode and the second electrode of the driving transistor T1. The first driving sub-circuit 102 is connected to the first node N1 and the first power supply voltage signal terminal VDD. The first control sub-circuit 103 is connected to the enable signal terminal EM, the first power supply voltage signal terminal VDD, the first electrode and the second electrode of the driving transistor T1, and the element to be driven D.

Referring to FIGS. 3 and 14, S10 and S30 described above include S102 and S302, respectively.

In S102, in each of the plurality of row scanning phases, the first data writing sub-circuit 101 writes the data signal from the data signal terminal Data and the first threshold voltage $V_{th1}$ of the driving transistor T1 into the first node N1 in response to the scan signal received from the scan signal terminal S.

In S302, in the operating phase, the driving transistor T1 outputs the driving signal according to the data signal provided from the data signal terminal Data and the first power supply voltage signal provided from the first power supply voltage signal terminal VDD. In response to the enable signal received from the enable signal terminal EM, the first control sub-circuit 103 connects the first electrode of the driving transistor T1 to the first power supply voltage signal terminal VDD, and connects the second electrode of the driving transistor T1 to the element to be driven D.

For example, as shown in FIG. 5, the first data writing sub-circuit 101 includes the fourth transistor T4 and the fifth transistor T5. The first driving sub-circuit 102 includes the driving transistor T1 and the first capacitor C1. The first control sub-circuit 103 includes the sixth transistor T6 and the seventh transistor T7. The connection modes of the driving transistor T1, the first capacitor C1, the fourth transistor T4, the fifth transistor T5, the sixth transistor T6, and the seventh transistor T7 refer to the above description, which will not be repeated here.

Referring to FIGS. 5 and 14, S102 and S302 described above include S1021 and S3021, respectively.

In S1021, in each of the plurality of row scanning phases, the fourth transistor T4 is turned on in response to the scan signal received from the scan signal terminal S, so that the data signal provided from the data signal terminal Data is transmitted to the first electrode of the driving transistor T1. The fifth transistor T5 is turned on in response to the scan signal received from the scan signal terminal S, so as to short-circuit the gate of the driving transistor T1 to the second electrode thereof.

By short-circuiting the gate of the driving transistor T1 to the second electrode of the driving transistor T1, the driving transistor T1 is in the saturation state. The data signal and the first threshold voltage are written into the first node N1, so that the voltage of the first node N1 is a sum of the voltage $V_{data}$ provided from the data signal and the first threshold voltage $V_{th1}$. That is, the voltage of the first node N1 is $V_{data}+V_{th1}$, which realizes the threshold voltage compensation on the driving transistor T1. Thus, the driving signal (the driving current) output from the driving transistor T1 is unrelated to the first threshold voltage $V_{th1}$ thereof. After each scanning phase is over, the gate voltage of the driving transistor T1 is equal to the voltage of the first node N1, i.e., equal to $V_{data}+V_{th1}$.

Since the end of the first capacitor C1 is connected to the first node N1, the voltage at the end of the first capacitor C1 is the voltage of the first node N1, i.e., $V_{data}+V_{th1}$. The another end of the first capacitor C1 is connected to the first power supply voltage signal terminal VDD, and thus, the voltage at the another end of the first capacitor C1 is the voltage $V_{dd}$ of the first power supply voltage signal. Since $V_{data}+V_{th1}$ is not equal to $V_{dd}$, so that the voltage difference is present between the two ends of the first capacitor C1, the first capacitor C1 is charged.

In S3021, in the operating phase, the driving transistor T1 outputs the driving signal according to the data signal stored in the first capacitor C1, the first threshold voltage $V_{th1}$ of the driving transistor T1, and the first power supply voltage signal provided from the first power supply voltage signal terminal VDD. The sixth transistor is turned on in response to the enable signal received from the enable signal terminal EM, so that the first electrode of the driving transistor T1 is connected to the first power supply voltage signal terminal VDD. The seventh transistor T7 is turned on in response to the enable signal received from the enable signal terminal EM, so that the second electrode of the driving transistor T1 is connected to the first electrode of the element to be driven D.

Since the first electrode of the driving transistor T1 is connected to the first power supply voltage signal terminal VDD, the voltage of the first electrode of the driving transistor T1 is equal to the voltage $V_{dd}$ of the first power supply voltage signal provided from the first power supply voltage signal terminal VDD. In the case where the driving transistor T1 is the P-type transistor, when $V_{data}+V_{th1}-V_{dd}<V_{th1}$, the driving transistor T1 is in the on state, and outputs the driving signal to the element to be driven D, so that the element to be driven D emits light.

In some embodiments, as shown in FIGS. 2 and 3, the driving duration control sub-circuit 20 includes the second data writing sub-circuit 201, the second driving sub-circuit 202, the second control sub-circuit 203, and the third control sub-circuit 204. The second driving sub-circuit 202 includes the tenth transistor T10 and the second capacitor C2. An end of the second capacitor C2 is connected to the second node N2, another end of the second capacitor C2 is connected to the third node N3. The gate of the tenth transistor T10 is connected to the third node N3. The second data writing sub-circuit 201 is connected to the second reset signal terminal RST2, the first voltage signal terminal V1, and the second node N2. The second control sub-circuit 203 is connected to the enable signal terminal EM, the second voltage signal terminal V2, the third voltage signal terminal V3, the second node N2, and the tenth transistor T10. The third control sub-circuit 204 is connected to the control signal terminal CTR, the tenth transistor T10, and the first node N1.

S20 and S40 described above include S201 and S401, respectively.

In S201, in each of the plurality of row scanning phases, the second data writing sub-circuit 201 writes the first voltage signal provided from the first voltage signal terminal V1 into the second node N2 in response to the second reset signal received from the second reset signal terminal RST2.

In S401, in the operating phase, in response to the enable signal received from the enable signal terminal EM, the second control sub-circuit 203 writes the third voltage signal changing within the set voltage range that is provided from the third voltage signal terminal V3 into the second node N2, and connects the tenth transistor T10 to the second voltage signal terminal V2. The third control sub-circuit 204 connects the tenth transistor T10 to the first node N1 in response to the control signal received from the control signal terminal CTR. The tenth transistor T10 transmits the second voltage signal provided from the second voltage signal terminal V2 to the first node N1 in response to the voltage variation between the third voltage signal and the first voltage signal at the second node N2.

For example, as shown in FIGS. 4, 5 and 7, the second driving sub-circuit 202 includes the second capacitor C2 and the tenth transistor T10. The second control sub-circuit 203 includes the eleventh transistor T11 and the twelfth transistor T12. The third control sub-circuit 204 includes the thirteenth transistor T13. The second data writing sub-circuit 201 includes the fourteenth transistor T14. The connection modes of the second capacitor C2, the tenth transistor T10, the eleventh transistor T11, the twelfth transistor T12, the thirteenth transistor T13, and the fourteenth transistor T14 refer to the above description, which will not be repeated here.

Referring to FIGS. 4, 5, 7, and 13, S201 and S401 described above include S2011 and S4011, respectively.

In S2011, in each of the plurality of row scanning phases, the fourteenth transistor T14 is turned on in response to the second reset signal received from the second reset signal terminal RST2, so that the first voltage signal provided from the first voltage signal terminal V1 is written into the second node N2.

After each row scanning phase is over, the voltage of the second node N2 is the voltage $V_{com1}$ of the first voltage signal provided from the first voltage signal terminal V1, and the voltage of the third node N3 is 0. Before the start of the operating phase, the tenth transistor T10 is in the off state, and the voltage of the second electrode of the tenth transistor T10 is equal to the voltage of the first node N1. For example, for the pixel driving circuit shown in FIG. 5 or FIG. 7, the voltage of the second electrode of the tenth transistor T10 is equal to $V_{data}+V_{th1}$.

In S4011, in the operating phase, the eleventh transistor T11 is turned on in response to the enable signal received from the enable signal terminal EM, so that the third voltage signal changing within the set voltage range that is provided from the third voltage signal terminal V3 is transmitted to the second node N2. The twelfth transistor T12 is turned on in response to the enable signal received from the enable signal terminal EM, so that the first electrode of the tenth transistor T10 is connected to the second voltage signal terminal V2. The thirteenth transistor T13 is turned on in response to the control signal received from the control signal terminal CTR, so that the second electrode of the tenth transistor T10 is connected to the first node N1. The tenth transistor T10 is turned on in response to the voltage variation between the third voltage signal and the first voltage signal at the second node N2, so that the second voltage signal provided from the second voltage signal terminal V2 is transmitted to the first node N1.

Referring to FIGS. 5 and 13, or, referring to FIGS. 7 and 14, in the operating phase, the fourteenth transistor T14 is turned off, the tenth transistor T10 receives the third voltage signal whose voltage gradually changes, and changes from off to on, and the eleventh transistor T11, the twelfth transistor T12, and the thirteenth transistor T13 are turned on. The time duration during which the tenth transistor T10 changes from off to on is the luminous duration of the element to be driven D.

In the operating phase, when the third voltage signal provided from the third voltage signal terminal V3 is written into the second node N2, the voltage of the second node N2 changes from the voltage $V_{com1}$ of the first voltage signal to the voltage $V_x$ of the third voltage signal. According to the law of conservation of charge of the capacitor, the change affects the voltage of the third node N3, and the voltage of the third node N3 will change as the voltage of the second node N2 changes. That is, the voltage of the third node N3 changes from 0 to $V_x-V_{com1}$.

Since the gate of the tenth transistor T10 is connected to the third node N3, the gate voltage of the tenth transistor T10 is $V_x-V_{com1}$.

In a case where the tenth transistor T10 is an N-type transistor, when $V_x-V_{com1}-(V_{data}+V_{th1})>V_{th2}$, the tenth transistor T10 is in the on state, and transmits the second voltage signal provided from the second voltage signal terminal V2 to the first node N1, so that the driving transistor T1 is turned off, thereby controlling the luminous duration of the element to be driven D.

It will be noted that for the pixel driving circuit in FIG. 4, the voltage of the second electrode of the tenth transistor T10 is equal to $V_{data}$. In the case where the tenth transistor T10 is the N-type transistor, when $V_3-V_{com1}-V_{data}>V_{th2}$, the tenth transistor T10 is in the on state.

In some other embodiments, as shown in FIGS. 10, 11, and 12, the driving duration control sub-circuit 20 includes the second data writing sub-circuit 201, the second driving sub-circuit 202, the second control sub-circuit 203, and the third control sub-circuit 204. The second driving sub-circuit 202 includes the tenth transistor T10 and the second capacitor C2. An end of the second capacitor C2 is connected to the second node N2, another end of the second capacitor C2 is connected to the third node N3. The gate of the tenth transistor T10 is connected to the third node N3. The second data writing sub-circuit 201 is connected to the second reset signal terminal RST2, the first voltage signal terminal V1, the second node N2, the reference voltage signal terminal Ref, and the tenth transistor T10. The second control sub-circuit 203 is connected to the enable signal terminal EM, the second voltage signal terminal V2, the third voltage signal terminal V3, the second node N2, and the tenth transistor T10. The third control sub-circuit 204 is connected to the control signal terminal CTR, the tenth transistor T10, and the first node N1.

S20 and S40 described above include S202 and S402, respectively.

In S202, in each of the plurality of row scanning phases, in response to the second reset signal received from the second reset signal terminal RST2, the second data writing sub-circuit 201 writes the first voltage signal provided from the first voltage signal terminal V1 into the second node N2, and writes the reference voltage signal provided from the reference voltage signal terminal Ref into the third node N3.

In S402, in the operating phase, in response to the enable signal received from the enable signal terminal EM, the second control sub-circuit 203 writes the third voltage signal changing within the set voltage range that is provided from the third voltage signal terminal V3 into the second node N2, and connects the tenth transistor T10 to the second voltage signal terminal V2. The third control sub-circuit 204 connects the tenth transistor T10 to the first node N1 in response to the control signal received from the control signal terminal CTR. The tenth transistor T10 transmits the second voltage signal provided from the second voltage signal terminal V2 to the first node N1 in response to the voltage variation between the third voltage signal and the first voltage signal at the second node N2.

For example, as shown in FIGS. 10, 11, 12, and 14, the second driving sub-circuit 202 includes the second capacitor C2 and the tenth transistor T10. The second control sub-circuit 203 includes the eleventh transistor T11 and the twelfth transistor T12. The third control sub-circuit 204 includes the thirteenth transistor T13. The second data writing sub-circuit 201 includes the fourteenth transistor T14, the fifteenth transistor T15, and the sixteenth transistor T16. The connection modes of the second capacitor C2, the tenth transistor T10, the eleventh transistor T11, the twelfth transistor T12, the thirteenth transistor T13, the fourteenth transistor T14, the fifteenth transistor T15, and the sixteenth transistor T16 refer to the above description, which will not be repeated here.

Referring to FIGS. 10, 11, 12, and 14, S202 and S402 described above include S2021 and S4021, respectively.

In S2021, in each of the plurality of row scanning phases, the fourteenth transistor T14 is turned on in response to the second reset signal received from the second reset signal terminal RST2, so that the first voltage signal provided from the first voltage signal terminal V1 is written into the second node N2.

The fifteenth transistor T15 and the sixteenth transistor T16 are turned on in response to the second reset signal received from the second reset signal terminal RST2, so that the reference voltage signal provided from the reference voltage signal terminal Ref and the second threshold voltage $V_{th2}$ of the tenth transistor T10 are written into the third node N3.

An end of the second capacitor C2 is connected to the second node N2, and another end of the second capacitor C2 is connected to the third node N3. Therefore, a voltage difference is present between the two ends of the second capacitor C2. After the scanning phase is over, the voltage of the second node N2 is the voltage $V_{com1}$ of the first voltage signal provided from the first voltage signal terminal V1, and the voltage of the third node N3 is a sum of the second threshold voltage $V_{th2}$ and the voltage $V_{Ref}$ of the reference voltage signal. That is, the voltage of the third node N3 is equal to $V_{th2}+V_{Ref}$. In this case, the voltage difference between the two ends of the second capacitor C2 is $V_{com1}-(V_{th2}+V_{Ref})$. Before the start of the operating phase, the tenth transistor T10 is in the off state, and the voltage of the second electrode of the tenth transistor T10 is equal to the voltage of the first node N1. Taking the pixel driving circuit shown in FIG. 11 or FIG. 12 as an example, the voltage of the second electrode of the tenth transistor T10 is equal to $V_{data}+V_{th1}$.

In S4021, in the operating phase, the eleventh transistor T11 is turned on in response to the enable signal received from the enable signal terminal EM, so that the third voltage signal changing within the set voltage range that is provided from the third voltage signal terminal V3 is transmitted to the second node N2. The twelfth transistor T12 is turned on in response to the enable signal received from the enable signal terminal EM, so that the tenth transistor T10 is connected to the second voltage signal terminal V2. The thirteenth transistor T13 is turned on in response to the control signal received from the control signal terminal CTR, so that the tenth transistor T10 is connected to the first node N1. The tenth transistor T10 is turned on in response to the voltage variation between the third voltage signal and the first voltage signal at the second node N2, so that the second voltage signal provided from the second voltage signal terminal V2 is transmitted to the first node N1.

Referring to FIGS. 10 and 13, or, referring to FIGS. 11 and 14, or, referring to FIGS. 12 and 14, in the operating phase, the fourteenth transistor T14, the fifteenth transistor T15, and the sixteenth transistor T16 are turned off, the eleventh transistor T11, the twelfth transistor T12, and the thirteenth transistor T13 are turned on, and the tenth transistor T10 receives the third voltage signal whose voltage gradually changes, and changes from off to on. The time duration during which the tenth transistor T10 changes from off to on is the luminous duration of the element to be driven D.

In the operating phase, when the third voltage signal provided from the third voltage signal terminal V3 is written into the second node N2, the voltage of the second node N2 changes from the voltage $V_{com1}$ of the first voltage signal to the voltage $V_x$ of the third voltage signal. According to the law of conservation of charge of the capacitor, the voltage of the third node N3 changes from $V_{th2}+V_{Ref}$ to $V_{th2}+V_{Ref}$ $(V_3-V_{com1})$.

The gate voltage of the tenth transistor T10 is equal to the voltage of the third node N3. In the case where the tenth transistor T10 is the N-type transistor, when $V_{th2}+V_{Ref}+(V_3-V_{com1})-(V_{data}+V_{th1})>V_{th2}$, the tenth transistor T10 is in the on state, and transmits the second voltage signal provided from the second voltage signal terminal V2 to the first node N1, so that the driving transistor T1 is turned off, thereby controlling the luminous duration of the element to be driven D.

It will be noted that for the pixel driving circuit shown in FIG. 10, the voltage of the second electrode of the tenth transistor T10 is equal to $V_{data}$. In the case where the tenth transistor T10 is the N-type transistor, when $V_{th2}+V_{Ref}+(V_3-V_{com1})-V_{data}>V_{th2}$, the tenth transistor T10 is in the on state.

In the driving method of the pixel driving circuit provided by some embodiments of the present disclosure, in the scanning phase, although the third voltage signal provided from the third voltage signal terminal V3 is not transmitted to the second driving sub-circuit 202 due to the control of the second control sub-circuit 203, in consideration of reducing mutual interferences between the signals and improving the operating stability of the pixel driving circuit 1, in the scanning phase, the voltage of the third voltage signal may be set to a constant value, so as to avoid fluctuations in the third voltage signal. The constant value is, for example, equal to the voltage $V_a$.

In the N row scanning phases, each row scanning phase includes S10 and S20 described above. In this way, the data signals and the first voltage signals may be written into and stored in the pixel driving circuits 1 in the sub-pixel regions in N rows, which prepares for the output of the driving signal in the operating phase.

For example, for the pixel driving circuit in FIG. 4, in combination with FIG. 13, in each row scanning phase, the second transistor T2 and the fourteenth transistor T14 are turned on, the driving transistor T1, the third transistor T3, the eleventh transistor T11, the twelfth transistor T12, and the thirteenth transistor T13 are turned off, and the tenth transistor T10 is in the saturation state.

For example, for the pixel driving circuit in FIG. 5, in combination with FIG. 14, in each row scanning phase, the driving transistor T1, the fourth transistor T4, the fifth transistor T5, and the fourteenth transistor T14 are turned on, the sixth transistor T6, the seventh transistor T7, the eleventh transistor T11, the twelfth transistor T12, and the thirteenth transistor T13 are turned off, and the tenth transistor T10 is in the saturation state.

For example, for the pixel driving circuit in FIG. 10, in combination with FIG. 13, in each row scanning phase, the second transistor T2, the tenth transistor T10, the fourteenth transistor T14, the fifteenth transistor T15, and the sixteenth transistor T16 are turned on, and the driving transistor T1, the third transistor T3, the eleventh transistor T11, the twelfth transistor T12, and the thirteen transistor T13 are turned off.

For example, for the pixel driving circuit in FIG. 11, in combination with FIG. 14, in each row scanning phase, the driving transistor T1, the fourth transistor T4, the fifth transistor T5, the tenth transistor T10, the fourteenth transistor T14, the fifteenth transistor T15, and the sixteenth transistor T16 are turned on, and the sixth transistor T6, the seventh transistor T7, the eleventh transistor T11, the twelfth transistor T12, and the thirteenth transistor T13 are turned off.

For example, for the pixel driving circuit in FIG. 12, in combination with FIG. 14, since the driving control sub-circuit 10 includes the reset sub-circuit 104, each row scanning phase further includes a reset stage. In the reset phase, the eighth transistor T8, the ninth transistor T9, the tenth transistor T10, the fourteenth transistor T14, the fifteenth transistor T15, and the sixteenth transistor T16 are turned on, and the fourth transistor T4, the fifth transistor T5, the sixth transistor T6, the seventh transistor T7, the eleventh transistor T11, the twelfth transistor T12, and the thirteenth transistor T13 are turned off. After the reset phase is over, the driving transistor T1, the fourth transistor T4, and the fifth transistor T5 are turned on, the tenth transistor T10, the fourteenth transistor T14, the fifteenth transistor T15, and the sixteenth transistor T16 remain on, the sixth transistor T6, the seventh transistor T7, the eleventh transistor T11, the twelfth transistor T12, and the thirteenth transistor T13 remain off, and the eighth transistor T8 and the ninth transistor T9 are turned off.

In the driving method of the pixel driving circuit provided by some embodiments of the present disclosure, as shown in FIGS. 13 and 14, the voltage of the third voltage signal provided from the third voltage signal terminal V3 changes within the set range of $V_a$ to $V_b$. Since the third voltage signal needs to cooperate with the data signal to turn on the tenth transistor T10, a specific value of the third voltage signal within the set voltage range thereof changes as the data signal changes. When the value of the third voltage signal within the set voltage range is different, the luminous duration of the element to be driven D is different.

In some examples, the third voltage signal may be of a triangular waveform, but the embodiments of the present disclosure are not limited thereto.

It will be noted that the second voltage signal needs to be set according to the type of the driving transistor T1. When the driving transistor T1 is a P-type transistor, the voltage of the second voltage signal is a high voltage, so that the driving transistor T1 is turned off. When the driving transistor T1 is an N-type transistor, the voltage of the second voltage signal is a low voltage, so that the driving transistor T1 is turned off. FIG. 13 or FIG. 14 only exemplarily illustrates that the voltage of the second voltage signal is a low voltage, and the embodiments of the present disclosure are not limited thereto.

In addition, as shown in FIG. 13, some embodiments of the present disclosure are illustrated in an example where the voltage of the first voltage signal provided from the first voltage signal terminal V1, the voltage of the second voltage signal provided from the second voltage signal terminal V2, and the voltage of the reference voltage signal provided from the reference voltage signal terminal Ref are low voltages, but the embodiments of the present disclosure are not limited thereto. In a case where the first voltage signal, the second voltage signal, and the reference voltage signal are the same, the three may also use a same signal line to transmit signals. As shown in FIG. 14, in a case where the driving control sub-circuit 10 includes the reset sub-circuit 104, the voltage of the initial voltage signal provided from the initial signal terminal Vint is a low voltage, but the embodiments of the present disclosure are not limited thereto. In a case where the first voltage signal, the second voltage signal, the reference voltage signal, and the initial voltage signal are the same, the four may also use a same signal line to transmit signals.

The driving method of the pixel driving circuit provided by some embodiments of the present disclosure has same beneficial effects as the pixel driving circuit 1 described above, which will not be repeated here.

Some embodiments of the present disclosure further provide a display panel. The display panel includes a plurality of pixel driving circuits 1 and a plurality of elements to be driven D as described above. Each element to be driven D is connected to a corresponding pixel driving circuit 1.

Figure 15:
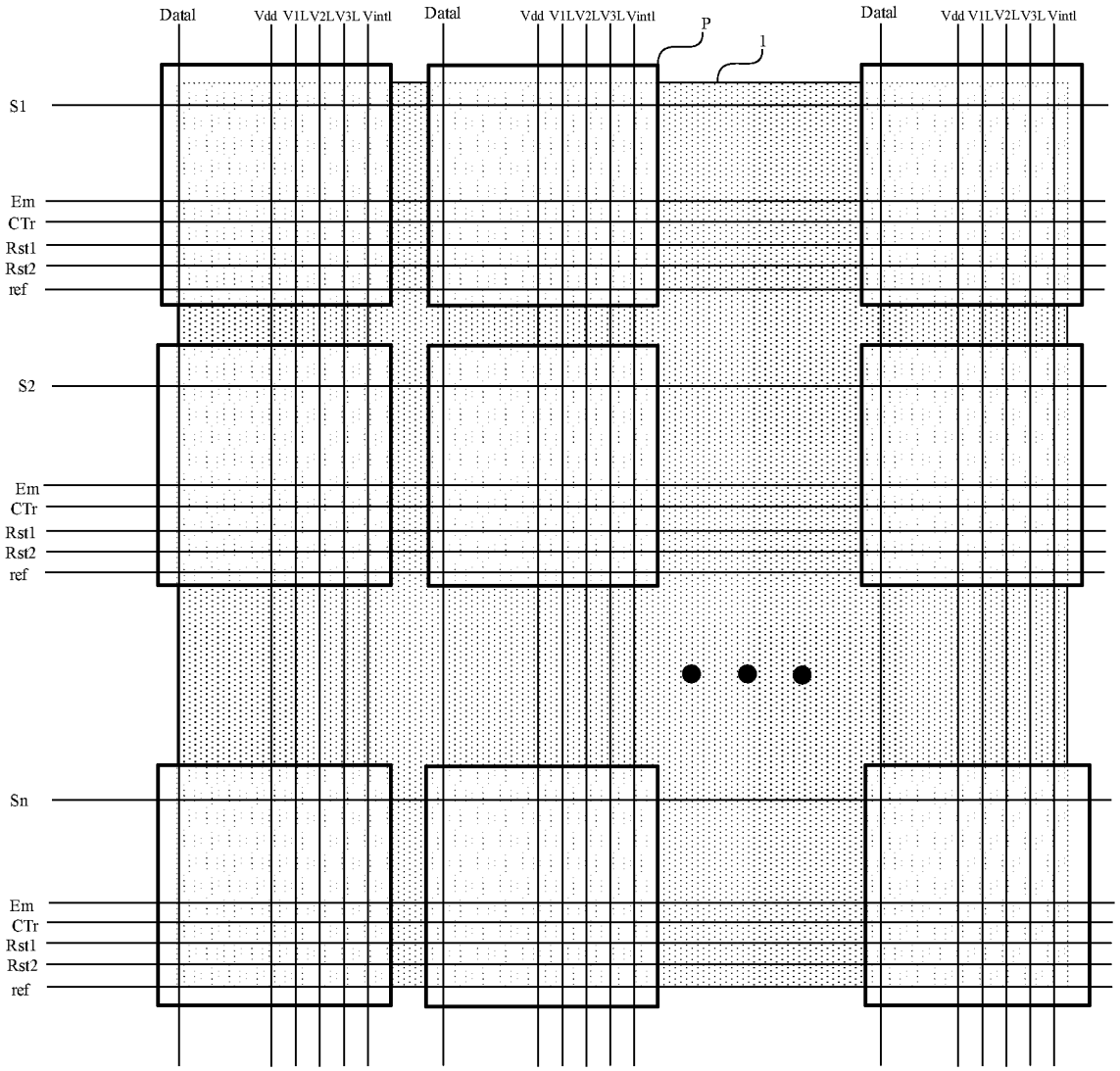
FIG. 15 is a schematic structural diagram of a display panel, in accordance with some embodiments of the present disclosure.

In some embodiments, as shown in FIG. 15, the display panel has a plurality of sub-pixel regions P, and each pixel driving circuit 1 is disposed in one sub-pixel region P.

The display panel includes a plurality of scan signal lines, a plurality of data signal lines, a plurality of enable signal lines, and a plurality of third voltage signal lines. Scan signal terminals S connected to the pixel driving circuits 1 located in a same row of sub-pixel regions P are connected to a corresponding scan signal line. Data signal terminals Data connected to the pixel driving circuits 1 located in a same column of sub-pixel regions are connected to a corresponding data signal line. Enable signal terminals EM connected to the pixel driving circuits located in a same row of sub-pixel regions are connected to a corresponding enable signal line. Third voltage signal terminals V3 connected to the pixel driving circuits 1 located in a same column of sub-pixel regions are connected to a corresponding third voltage signal line. Here, the scan signal terminal S connected to the pixel driving circuit 1 may be understood as an equivalent connection point after the scan signal line is connected to the pixel driving circuit 1. Similarly, the data signal terminal Data connected to the pixel driving circuit 1 may be understood as an equivalent connection point after the data signal line is connected to the pixel driving circuit 1. The enable signal terminal EM connected to the pixel driving circuit 1 may be understood as an equivalent connection point after the enable signal line is connected to the pixel driving circuit 1. The third voltage signal terminal V3 connected to the pixel driving circuit 1 may be understood as an equivalent connection point after the third voltage signal line is connected to the pixel driving circuit 1.

For example, as shown in FIG. 15, each pixel driving circuit 1 is disposed in one sub-pixel region P, and a plurality of sub-pixel regions P are distributed in a form of a plurality rows and a plurality columns.

As shown in FIG. 15, the display panel includes the plurality of scan signal lines S1 to Sn, the plurality of enable signal lines Em, a plurality of control signal lines CTr, a plurality of first reset signal lines Rst1, a plurality of second reset signal lines RST2, and a plurality of reference voltage signal lines ref. The scan signal line is configured to provide a scan signal to the pixel driving circuit 1. The enable signal line Em is configured to provide an enable signal to the pixel driving circuit 1. The control signal line CTr is configured to provide a control signal to the pixel driving circuit 1. The first reset signal line Rst1 is configured to provide a first reset signal to the pixel driving circuit 1. The second reset signal line Rst2 is configured to provide a second reset signal to the pixel driving circuit 1. The reference voltage signal line ref is configured to provide a reference voltage signal to the pixel driving circuit 1. The pixel driving circuits 1 in the same row of sub-pixel regions P are connected to a same one of the plurality of scan signal lines S1 to Sn, a same one of the plurality of enable signal lines Em, a same one of the plurality of control signal lines CTr, a same one of the plurality of first reset signal lines Rst1, a same one of the plurality of second reset signal lines Rst2, and a same one of the plurality of reference voltage signal lines ref.

The display panel further includes the plurality of data signal lines DataI, a plurality of first power supply voltage lines Vdd, a plurality of first voltage signal lines V1L, a plurality of second voltage signal lines V2L, the plurality of third voltage signal lines V3L, and a plurality of initial voltage signal lines VintI. The data signal line DataI is configured to provide a data signal to the pixel driving circuit 1. The first power supply voltage line Vdd is configured to provide a first power supply voltage signal to the pixel driving circuit 1. The first voltage signal line V1L is configured to provide a first voltage signal to the pixel driving circuit 1. The second voltage signal line V2L is configured to provide a second voltage signal to the pixel driving circuit 1. The third voltage signal line V3L is configured to provide a third voltage signal to the pixel driving circuit 1. The initial voltage signal line VintI is configured to provide an initial voltage signal to the pixel driving circuit 1. The pixel driving circuits 1 in the same column of sub-pixel regions P are connected to a same one of the plurality of data signal lines DataI, a same one of the plurality of first power supply voltage lines $V_{dd}$, a same one of the plurality of first voltage signal lines V1L, a same one of the plurality of second voltage signal lines V2L, a same one of the third voltage signal lines V3L, and a same one of the plurality of initial voltage signal lines VintI.

When the display panel is operating, in a plurality of row scanning phases, starting from the pixel driving circuits 1 located in a first row of sub-pixel regions P, the plurality of data lines DataI input the data signals to the pixel driving circuits 1 in the row of sub-pixel regions P, until the data signals are input to the pixel driving circuits 1 in a last row of sub-pixel regions P. The data signals input to the pixel driving circuits 1 in respective rows of sub-pixel regions may be the same or different, which is not limited in the embodiments of the present disclosure.

Starting from the pixel driving circuits 1 located in a first column of sub-pixel regions P, the plurality of first voltage signal lines V1L input the first voltage signals to the pixel driving circuits 1 in the column of sub-pixel regions P, until the first voltage signals are input to the pixel driving circuits 1 located in a last column of the sub-pixel regions P.

In the operating phase, the plurality of first power supply voltage lines $V_{dd}$ synchronously input the first power supply voltage signals to the pixel driving circuits 1 in all sub-pixel regions P, so that each pixel driving circuit 1 outputs the driving signal according to the data signal and the first power supply voltage signal, thereby driving the element to be driven D connected to the pixel driving circuit 1 to emit light.

The plurality of third voltage signal lines V3L synchronously input the same third voltage signals to the pixel driving circuits 1 in all rows of sub-pixel regions P. The tenth transistor T10 is turned on in response to the voltage variation between the third voltage signal and the first voltage signal. The plurality of second voltage signal lines V2L synchronously input the same second voltage signals to the pixel driving circuits 1 in all rows of sub-pixel regions P. In response to the turn-on of the tenth transistor T10 in the pixel driving circuit 1, the second voltage signal is transmitted to the driving transistor T1 in the pixel driving circuit 1, so that the driving transistor T1 is turned off, and the element to be driven D connected to the pixel driving circuit 1 stops emitting light.

It will be noted that although the third voltage signals input to the pixel driving circuits 1 in all rows of sub-pixel regions P are the same, the third voltage signal has the set voltage range, and the data signals received by the pixel driving circuits 1 in respective rows of sub-pixel regions 1 may be different, and different data signals correspond to specific voltages within the set voltage range of the third voltage signal. Therefore, for any pixel driving circuit 1, the specific value of the corresponding third voltage signal may be different when the tenth transistor T10 is turned on. That is, the luminous duration of the element to be driven D is different. The correspondence here means that the tenth transistor T10 is turned on under an interaction of the data signal and the specific voltage.

It will be noted that the arrangements of the plurality of signal lines included in the display panel and a wiring diagram of the display panel shown in FIG. 15 are just some examples, and the embodiments of the present disclosure are not limited thereto.

The display panel provided by some embodiments of the present disclosure has same beneficial effects as the pixel driving circuit 1 described above, which will not be repeated here.

Some embodiments of the present disclosure further provide a display device. The display device includes the display panel as described above.

Since the display device includes the display panel, the display device has the characteristics of high luminous efficiency, stable brightness, low power consumption, and good display effects.

In some embodiments, the display device is a product with a display function, such as a TV, a mobile phone, a tablet computer, a notebook computer, a display, a digital photo frame, or a navigator, which is not limited in the embodiments of the present disclosure.

The foregoing descriptions are merely specific implementation manners of the present disclosure, but the protection scope of the present disclosure is not limited thereto. Changes or replacements that any person skilled in the art could conceive of within the technical scope disclosed by the present disclosure shall be included in the protection scope of the present disclosure. Therefore, the protection scope of the present disclosure shall be subject to the protection scope of the claims.

What is claimed is:

1. A pixel driving circuit, comprising:

a driving control sub-circuit including a first driving sub-circuit, the first driving sub-circuit being connected to a first node; the driving control sub-circuit being connected to a scan signal terminal, a data signal terminal, an enable signal terminal, a first power supply voltage signal terminal, and being configured to be connected to an element to be driven; the driving control sub-circuit being configured to: in response to a scan signal received from the scan signal terminal, write at least a data signal provided from the data signal terminal into the first node; and in response to an enable signal received from the enable signal terminal, enable the first driving sub-circuit to output a driving signal according to the data signal and a first power supply voltage signal provided from the first power supply voltage signal terminal, so as to drive the element to be driven to operate; and a driving duration control sub-circuit including a second driving sub-circuit, the second driving sub-circuit being connected to a second node; the driving duration control sub-circuit being connected to a control signal terminal, the enable signal terminal, a second reset signal terminal, a first voltage signal terminal, a second voltage signal terminal, a third voltage signal terminal, and the first node; the driving duration control sub-circuit being configured to: in response to a second reset signal received from the second reset signal terminal, write a first voltage signal provided from the first voltage signal terminal into the second node; in response to the enable signal received from the enable signal terminal and a control signal received from the control signal terminal, write a third voltage signal changing within a set voltage range that is provided from the third voltage signal terminal into the second node; and in response to a voltage variation at the second node, transmit a second voltage signal provided from the second voltage signal terminal to the first node to stop the first driving sub-circuit from outputting the driving signal, so as to control an operating duration of the element to be driven.

2. The pixel driving circuit according to claim 1, wherein the driving control sub-circuit further includes a first data writing sub-circuit and a first control sub-circuit;

the first data writing sub-circuit is at least connected to the scan signal terminal, the data signal terminal, and the first node; the first data writing sub-circuit is configured to write at least the data signal into the first node in response to the received scan signal;

the first driving sub-circuit is further connected to the first power supply voltage signal terminal; the first driving sub-circuit includes a driving transistor, and the driving transistor is configured to output the driving signal according to the data signal and the first power supply voltage signal; and the first control sub-circuit is connected to the enable signal terminal, a second electrode of the driving transistor, and is configured to be connected to the element to be driven; the first control sub-circuit is configured to, in response to the received enable signal, connect the second electrode of the driving transistor to the element to be driven, so as to transmit the driving signal to the element to be driven.

3. The pixel driving circuit according to claim 2, wherein the first data writing sub-circuit is further connected to a first electrode and the second electrode of the driving transistor; the first data writing sub-circuit is further configured to, in response to the received scan signal, write a first threshold voltage of the driving transistor into the first node, so as to perform a threshold voltage compensation on the driving transistor; and the first control sub-circuit is further connected to the first electrode of the driving transistor and the first power supply voltage signal terminal; the first control sub-circuit is further configured to, in response to the received enable signal, connect the first electrode of the driving transistor to the first power supply voltage signal terminal.

4. The pixel driving circuit according to claim 2, wherein the first driving sub-circuit further includes a first capacitor;

a gate of the driving transistor is connected to the first node, a first electrode of the driving transistor is connected to the first power supply voltage signal terminal;

an end of the first capacitor is connected to the first node, and another end of the first capacitor is connected to the first power supply voltage signal terminal;

and/or, the first data writing sub-circuit includes a second transistor; a gate of the second transistor is connected to the scan signal terminal, a first electrode of the second transistor is connected to the data signal terminal, and a second electrode of the second transistor is connected to the first node;

and/or, the first control sub-circuit includes a third transistor; a gate of the third transistor is connected to the enable signal terminal, a first electrode of the third transistor is connected to the second electrode of the driving transistor, and a second electrode of the third transistor is configured to be connected to the element to be driven.

5. The pixel driving circuit according to claim 3, wherein the first driving sub-circuit further includes a first capacitor;

a gate of the driving transistor is connected to the first node;

an end of the first capacitor is connected to the first node, and another end of the first capacitor is connected to the first power supply voltage signal terminal;

and/or, the first data writing sub-circuit includes a fourth transistor and a fifth transistor; a gate of the fourth transistor is connected to the scan signal terminal, a first electrode of the fourth transistor is connected to the data signal terminal, and a second electrode of the fourth transistor is connected to the first electrode of the driving transistor; and a gate of the fifth transistor is connected to the scan signal terminal, a first electrode of the fifth transistor is connected to the second electrode of the driving transistor, and a second electrode of the fifth transistor is connected to the first node;

and/or, the first control sub-circuit includes a sixth transistor and a seventh transistor; a gate of the sixth transistor is connected to the enable signal terminal, a first electrode of the sixth transistor is connected to the first power supply voltage signal terminal, and a second electrode of the sixth transistor is connected to the first electrode of the driving transistor; and a gate of the seventh transistor is connected to the enable signal terminal, a first electrode of the seventh transistor is connected to the second electrode of the driving transistor, and a second electrode of the seventh transistor is configured to be connected to the element to be driven.

6. The pixel driving circuit according to claim 2, wherein the driving control sub-circuit further includes a reset sub-circuit;

the reset sub-circuit is connected to a first reset signal terminal, an initial signal terminal, the first node, and is configured to be connected to the element to be driven; the reset sub-circuit is configured to, in response to a first reset signal received from the first reset signal terminal, transmit an initial voltage signal provided from the initial signal terminal to the first node and the element to be driven.

7. The pixel driving circuit according to claim 6, wherein the reset sub-circuit includes an eighth transistor and a ninth transistor;

a gate of the eighth transistor is connected to the first reset signal terminal, a first electrode of the eighth transistor is connected to the initial signal terminal, and a second electrode of the eighth transistor is connected to the first node;

a gate of the ninth transistor is connected to the first reset signal terminal, a first electrode of the ninth transistor is connected to the initial signal terminal, and a second electrode of the ninth transistor is configured to be connected to the element to be driven.

8. The pixel driving circuit according to claim 1, wherein the driving duration control sub-circuit further includes a second data writing sub-circuit, a second control sub-circuit, and a third control sub-circuit; the second driving sub-circuit includes a tenth transistor and a second capacitor; an end of the second capacitor is connected to the second node, another end of the second capacitor is connected to a third node, and a gate of the tenth transistor is connected to the third node;

the second data writing sub-circuit is connected to the second reset signal terminal, the first voltage signal terminal, and the second node; the second data writing sub-circuit is configured to, in response to the received second reset signal, write the first voltage signal into the second node;

the second control sub-circuit is connected to the enable signal terminal, the second voltage signal terminal, the third voltage signal terminal, the second node, and the tenth transistor; the second control sub-circuit is configured to, in response to the received enable signal, write the third voltage signal into the second node, and connect the tenth transistor to the second voltage signal terminal;

the third control sub-circuit is connected to the control signal terminal, the tenth transistor, and the first node; the third control sub-circuit is configured to, in response to the received control signal, connect the tenth transistor to the first node;

the tenth transistor is configured to, in response to a voltage variation between the third voltage signal and the first voltage signal at the second node, transmit the second voltage signal to the first node.

9. The pixel driving circuit according to claim 8, wherein the second data writing sub-circuit is further connected to a reference voltage signal terminal and the tenth transistor; the second data writing sub-circuit is further configured to, in response to the received second reset signal, write a reference voltage signal provided from the reference voltage signal terminal into the third node.

10. The pixel driving circuit according to claim 8, wherein the second control sub-circuit includes an eleventh transistor and a twelfth transistor;

a gate of the eleventh transistor is connected to the enable signal terminal, a first electrode of the eleventh transistor is connected to the third voltage signal terminal, and a second electrode of the eleventh transistor is connected to the second node;

a gate of the twelfth transistor is connected to the enable signal terminal, a first electrode of the twelfth transistor is connected to the second voltage signal terminal, and a second electrode of the twelfth transistor is connected to a first electrode of the tenth transistor;

and/or, the third control sub-circuit includes a thirteenth transistor;

a gate of the thirteenth transistor is connected to the control signal terminal, a first electrode of the thirteenth transistor is connected to a second electrode of the tenth transistor, and a second electrode of the thirteenth transistor is connected to the first node.

11. The pixel driving circuit according to claim 8, wherein the second data writing sub-circuit includes a fourteenth transistor;

a gate of the fourteenth transistor is connected to the second reset signal terminal, a first electrode of the fourteenth transistor is connected to the first voltage signal terminal, and a second electrode of the fourteenth transistor is connected to the second node.

12. The pixel driving circuit according to claim 9, wherein the second data writing sub-circuit includes a fourteenth transistor, a fifteenth transistor, and a sixteenth transistor;

a gate of the fourteenth transistor is connected to the second reset signal terminal, a first electrode of the fourteenth transistor is connected to the first voltage signal terminal, and a second electrode of the fourteenth transistor is connected to the second node;

a gate of the fifteenth transistor is connected to the second reset signal terminal, a first electrode of the fifteenth transistor is connected to the reference voltage signal terminal, and a second electrode of the fifteenth transistor is connected to a first electrode of the tenth transistor;

a gate of the sixteenth transistor is connected to the second reset signal terminal, a first electrode of the sixteenth transistor is connected to a second electrode of the tenth transistor, and a second electrode of the sixteenth transistor is connected to the third node.

13. A display panel, comprising:

a plurality of pixel driving circuits according to claim 1; and a plurality of elements to be driven, each element to be driven being connected to a corresponding pixel driving circuit.

14. The display panel according to claim 13, wherein the display panel has a plurality of sub-pixel regions, and each pixel driving circuit is disposed in one sub-pixel region;

the display panel further comprises:

a plurality of scan signal lines, scan signal terminals connected to pixel driving circuits located in a same row of sub-pixel regions being connected to a corresponding scan signal line;

a plurality of data signal lines, data signal terminals connected to pixel driving circuits located in a same column of sub-pixel regions being connected to a corresponding data signal line;

a plurality of enable signal lines, enable signal terminals connected to pixel driving circuits located in a same row of sub-pixel regions being connected to a corresponding enable signal line; and a plurality of third voltage signal lines, third voltage signal terminals connected to pixel driving circuits located in a same column of sub-pixel regions being connected to a corresponding third voltage signal line.

15. A driving method of the pixel driving circuit according to claim 1, a frame period including a scanning phase and an operating phase, and the scanning phase including a plurality of row scanning phases;

the driving method comprising:

in each of the plurality of row scanning phases:

writing, by the driving control sub-circuit, at least the data signal from the data signal terminal into the first node in response to the scan signal received from the scan signal terminal; and writing, by the driving duration control sub-circuit, the first voltage signal from the first voltage signal terminal into the second node in response to the second reset signal received from the second reset signal terminal; and in the operating phase:

in response to the enable signal received from the enable signal terminal, enabling, by the driving control sub-circuit, the first driving sub-circuit to output the driving signal according to the data signal and the first power supply voltage signal provided from the first power supply voltage signal terminal, so as to drive the element to be driven to operate;

in response to the enable signal received from the enable signal terminal and the control signal received from the control signal terminal, writing, by the driving duration control sub-circuit, the third voltage signal changing within the set voltage range from the third voltage signal terminal into the second node; and in response to the voltage variation between the third voltage signal and the first voltage signal, transmitting, by the driving duration control sub-circuit, the second voltage signal provided from the second voltage signal terminal to the first node to stop the first driving sub-circuit from outputting the driving signal, so as to control the operating duration of the element to be driven.

16. The driving method of the pixel driving circuit according to claim 15, wherein the driving control sub-circuit further includes a first data writing sub-circuit and a first control sub-circuit; the first data writing sub-circuit is at least connected to the scan signal terminal, the data signal terminal, and the first node; the first driving sub-circuit includes a driving transistor, and the first driving sub-circuit is connected to the first node and the first power supply voltage signal terminal; and the first control sub-circuit is connected to the enable signal terminal, a second electrode of the driving transistor, and the element to be driven;

in each of the plurality of row scanning phases, writing, by the driving control sub-circuit, at least the data signal into the first node in response to the received scan signal, and in the operating phase, in response to the received enable signal, enabling, by the driving control sub-circuit, the first driving sub-circuit to output the driving signal according to the data signal and the first power supply voltage signal, so as to drive the element to be driven to operate, includes:

in each of the plurality of row scanning phases:

writing, by the first data writing sub-circuit, the data signal into the first node in response to the received scan signal; and in the operating phase:

outputting, by the driving transistor, the driving signal according to the data signal and the first power supply voltage signal; and connecting, by the first control sub-circuit, the second electrode of the driving transistor to the element to be driven in response to the received enable signal, so as to transmit the driving signal to the element to be driven to drive the element to be driven to operate.

17. The driving method of the pixel driving circuit according to claim 16, wherein the first data writing sub-circuit is further connected to a first electrode and the second electrode of the driving transistor; the first control sub-circuit is further connected to the first electrode of the driving transistor and the first power supply voltage signal terminal;

the driving method further comprises:

in each of the plurality of row scanning phases:

writing, by the first data writing sub-circuit, a first threshold voltage of the driving transistor into the first node in response to the received scan signal, so as to perform a threshold voltage compensation on the driving transistor; and in the operating phase:

connecting, by the first control sub-circuit, the first electrode of the driving transistor to the first power supply voltage signal terminal in response to the received enable signal, so that the first power supply voltage signal is transmitted to the driving transistor.

18. The driving method of the pixel driving circuit according to claim 15, wherein the driving duration control sub-circuit further includes a second data writing sub-circuit, a second control sub-circuit, and a third control sub-circuit; the second driving sub-circuit includes a tenth transistor and a second capacitor; an end of the second capacitor is connected to the second node, another end of the second capacitor is connected to a third node, and a gate of the tenth transistor is connected to the third node; the second data writing sub-circuit is connected to the second reset signal terminal, the first voltage signal terminal, and the second node; the second control sub-circuit is connected to the enable signal terminal, the second voltage signal terminal, the third voltage signal terminal, the second node, and the tenth transistor; the third control sub-circuit is connected to the control signal terminal, the tenth transistor, and the first node;

in each of the plurality of row scanning phases, writing, by the driving duration control sub-circuit, the first voltage signal into the second node in response to the received second reset signal, and in the operating phase, writing, by the driving duration control sub-circuit, the third voltage signal into the second node in response to the received enable signal and the control signal, and transmitting, by the driving duration control sub-circuit, the second voltage signal to the first node in response to the voltage variation between the third voltage signal and the first voltage signal, includes:

in each of the plurality of row scanning phases:

writing, by the second data writing sub-circuit, the first voltage signal into the second node in response to the received second reset signal; and in the operating phase:

writing the third voltage signal into the second node, and connecting the tenth transistor to the second voltage signal terminal, by the second control sub-circuit, in response to the received enable signal;

connecting, by the third control sub-circuit, the tenth transistor to the first node in response to the received control signal; and transmitting, by the tenth transistor, the second voltage signal to the first node in response to the voltage variation between the third voltage signal and the first voltage signal.

19. The driving method of the pixel driving circuit according to claim 18, wherein the second data writing sub-circuit is further connected to a reference voltage signal terminal and the tenth transistor;

the driving method further comprises:

in each of the plurality of row scanning phases:

writing, by the second data writing sub-circuit, a reference voltage signal provided from the reference voltage signal terminal into the third node in response to the received second reset signal.

* * * * *